US010359721B2

(12) United States Patent
Kaji

(10) Patent No.: US 10,359,721 B2
(45) Date of Patent: Jul. 23, 2019

(54) IMAGE FORMING APPARATUS THAT CHANGES A THRESHOLD TEMPERATURE OF A FIXING DEVICE DEPENDING ON AN OUTPUT FROM A COUNTER

(71) Applicant: CANON KABUSHIKI KAISHA, Tokyo (JP)

(72) Inventor: Keigo Kaji, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/427,601

(22) Filed: Feb. 8, 2017

(65) Prior Publication Data

US 2017/0146934 A1 May 25, 2017

Related U.S. Application Data

(63) Continuation of application No. PCT/JP2015/072940, filed on Aug. 7, 2015.

(30) Foreign Application Priority Data

Aug. 14, 2014 (JP) ..... 2014-165100

(51) Int. Cl.
*G03G 15/20* (2006.01)

(52) U.S. Cl.
CPC ..... *G03G 15/2039* (2013.01); *G03G 15/205* (2013.01); *G03G 15/2025* (2013.01);
(Continued)

(58) Field of Classification Search
CPC ..... G03G 15/2039; G03G 15/2042; G03G 15/205; G03G 15/2053; G03G 2215/2035
(Continued)

(56) References Cited

U.S. PATENT DOCUMENTS 7,437,086 B2 10/2008 Ono
7,457,576 B2 11/2008 Takada et al.
(Continued)

FOREIGN PATENT DOCUMENTS

JP 2002351254 A 12/2002
JP 2006163298 A 6/2006
(Continued)

OTHER PUBLICATIONS

International Search Report issued in International Patent Application No. PCT/JP2015/072940 dated Oct. 6, 2015.
(Continued)

*Primary Examiner* — Walter L Lindsay, Jr.
*Assistant Examiner* — Frederick Wenderoth
(74) *Attorney, Agent, or Firm* — Venable LLP

(57) ABSTRACT

An image forming apparatus includes a detecting element that detects a temperature of a heat generating member, a counter that counts a value corresponding to a cumulative time in which an endless belt is heated, and a controller that controls a timing of a start of image formation by an image forming portion depending on an output of the detecting element. When the value counted by the counter corresponds to a first cumulative time, the controller starts the image formation at a first timing when the detecting element carries out an output corresponding to a first temperature, and, when the value counted by the counter corresponds to a second cumulative time longer than the first, the controller starts the image formation at a second timing when the detecting element carries out an output corresponding to a lower second temperature.

20 Claims, 12 Drawing Sheets

(52) U.S. Cl.
CPC ..... *G03G 2215/0129* (2013.01); *G03G 2215/2035* (2013.01)

(58) Field of Classification Search
USPC ..... 399/69
See application file for complete search history.

(56) References Cited

U.S. PATENT DOCUMENTS

| | | | | |
|---|---|---|---|---|
| 8,068,758 | B2 | 11/2011 | Kaji | |
| 8,218,993 | B2 | 7/2012 | Kaji | |
| 8,971,746 | B2 | 3/2015 | Hasegawa et al. | |
| 2005/0201788 | A1* | 9/2005 | Kubochi | G03G 15/2039 399/381 |
| 2005/0265742 | A1* | 12/2005 | Kwon | G03G 15/2039 399/69 |
| 2006/0127112 | A1 | 6/2006 | Ono | |
| 2006/0223432 | A1* | 10/2006 | Niwa | B60H 1/00514 454/156 |
| 2009/0123170 | A1* | 5/2009 | Tatematsu | G03G 15/2039 399/68 |
| 2009/0246392 | A1* | 10/2009 | Miyamoto | C08K 3/04 427/385.5 |
| 2011/0081158 | A1* | 4/2011 | Wagatsuma | G03G 15/2039 399/70 |
| 2013/0121712 | A1 | 5/2013 | Kaji | |
| 2013/0322897 | A1* | 12/2013 | Yago | G03G 15/2053 399/33 |
| 2016/0085187 | A1* | 3/2016 | Takagi | G03G 15/2042 399/69 |

FOREIGN PATENT DOCUMENTS

| | | | |
|---|---|---|---|
| JP | 2007127866 | A | 5/2007 |
| JP | 2007163884 | A | 6/2007 |
| JP | 2008078028 | A | 4/2008 |
| JP | 2012198271 | A | 10/2012 |
| JP | 2014059549 | A | 4/2014 |

OTHER PUBLICATIONS

Office Action dated Mar. 27, 2018, issued in Japanese Patent Application No. 2014-165100.

* cited by examiner

IMAGE FORMING APPARATUS THAT CHANGES A THRESHOLD TEMPERATURE OF A FIXING DEVICE DEPENDING ON AN OUTPUT FROM A COUNTER

CLAIM TO PRIORITY

This application is a Bypass Continuation of International Patent Application No. PCT/JP2015/072940, filed on Aug. 7, 2015, which claims priority to Japanese Patent Application No. 2014-165100, filed on Aug. 14, 2015, the entireties of which are incorporated by reference herein.

TECHNICAL FIELD

The present invention relates to an image forming apparatus for forming an image on a recording material. Examples of an image forming apparatus include a copying machine, a printer, a facsimile machine, and a multi-function machine having a plurality of functions of these machines.

BACKGROUND ART

In the image forming apparatus, a toner image is formed on the recording material (sheet), and the recording material, on which the image is formed, is heated and pressed, so that the image is fixed on the recording material.

In Japanese Laid-Open Patent Application No. 2006-163298 and Japanese Laid-Open Patent Application No. 2014-59549, a fixing device for heating the toner image on the recording material by nipping the recording material at a nip between an endless belt, which is an example of a rotatable heating member, and a pressing roller, which is an example of a rotatable pressing member, is disclosed. In this fixing device, a heater is contacted to an inner surface side of the belt, so that the belt is heated. This heater is provided with a temperature detecting element for detecting a temperature of the heater, and the fixing device carries out electrical power supply to the heater on the basis of output of the temperature detecting element.

Further, an image forming apparatus disclosed in Japanese Laid-Open Patent Application No. 2006-163298 improves a first print out time by executing an image forming process in parallel to a temperature raising process of the fixing device. Specifically, when the temperature detecting element detects that the heater warms up to a temperature to some degree, feeding of the recording material is started so that the recording material is fed to the fixing device at timing when a temperature of the fixing device has increased to a fixing temperature.

In Japanese Laid-Open Patent Application No. 2002-351254, a temperature detecting sensor, including a sponge and a thermistor, is disclosed. Such a temperature detecting sensor changes in responsiveness depending on use status in some cases, and, therefore, in Japanese Laid-Open Patent Application No. 2012-198271, correction of a detected temperature is carried out using two temperature detecting sensors.

Problem to be Solved by the Invention

In a constitution in which the correction is carried out using the plurality of temperature sensors, as described above, however, it is difficult to meet the correction in a case in which a temperature performance of each of the plurality of temperature sensors changes. Thus, in the case in which feeding of the recording material is started using the temperature sensors changed in temperature performance, as described above, similarly as when a brand-new temperature sensor is used, a belt temperature at a timing when the recording material reaches the fixing device is different from a normal belt temperature. For that reason, toner is not properly heated, so that an image defect, such as uneven glossiness, can occur. Accordingly, even in the case in which responsiveness of the thermistor changed from that at the time of a state in which the thermistor was brand new, the image forming apparatus may desirably be one in which a defect does not generate in the image on a first sheet of the recording material heated immediately after temperature rising of the fixing device. An object of the present invention is to provide an image forming apparatus in which the generation of the image defect is suppressed.

Means for Solving the Problem

According to one aspect, the present invention provides an image forming apparatus comprising an image forming portion configured to carry out an image forming operation for forming an image on a recording material, a belt that is an endless belt for heating the recording material fed from the image forming portion and onto which a lubricant is applied at an inner surface thereof, a rotatable driving member configured to form a nip in cooperation with the belt and configured to rotationally drive the belt to feed the recording material, a heater provided in contact with the inner surface of the belt and configured to generate heat by energization, a supporting member configured to support the heater, a detecting portion configured to detect a temperature of the heater in contact with a surface opposite from one surface of the heater, and including an output element configured to carry out output depending on the temperature, and a heat insulating member provided between the output element and the supporting member, an acquiring portion configured to acquire information on a cumulative time in which the energization to the heater is carried out, and a controller configured to start the image forming operation at timing when the output element carries out output corresponding to a first temperature that is less than a predetermined temperature during a warming-up process in which the heater is heated to the predetermined temperature in a case in which the cumulative time is less than a predetermined time, and configured to start the image forming operation at timing when the output element carries out output corresponding to a second temperature that is less than the first temperature during the warming-up process of the heater in a case in which the cumulative time is not less than the predetermined time.

Effect of the Invention

According to the present invention, it is possible to provide the image forming apparatus in which the generation of the image defect was suppressed.

EMBODIMENTS FOR CARRYING OUT THE INVENTION

Figure 1:
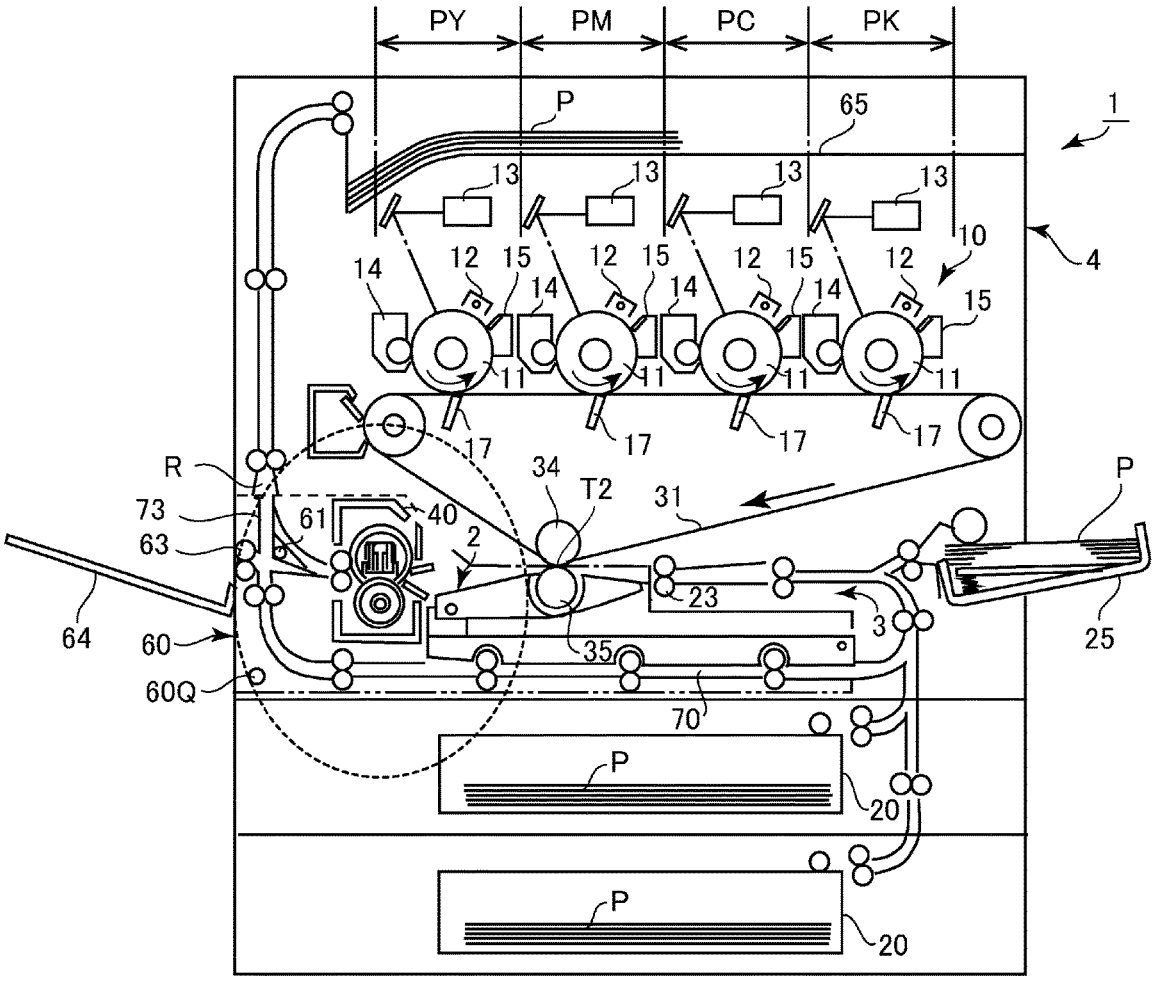
FIG. 1 is an illustration showing a structure of an image forming apparatus.

In the following description, with reference to the drawings, the best mode for carrying out the present invention will be illustratively described specifically Image Forming Apparatus FIG. 1 is an illustration showing a structure of an image forming apparatus 1. As shown in FIG. 1, the image forming apparatus 1 is a tandem-type, full-color printer of an intermediary transfer type in which image forming portions PY, PM, PC, PK, which form images of yellow, magenta, cyan, black color, respectively, are arranged along an intermediary transfer belt 31.

At the image forming portion PY, a yellow toner image is formed on a photosensitive drum 11(Y), and is transferred onto the intermediary transfer belt 31. At the image forming portion PM, a magenta toner image is formed on a photosensitive drum 11(M), and is transferred onto the intermediary transfer belt 31. At the image forming portions PC and PK, a cyan toner image and a black toner image are formed on the photosensitive drums 11(C) and 11(K), respectively, and are successively transferred onto the intermediary transfer belt 31.

Between the intermediary transfer belt 31, which is supported by an inner secondary transfer roller 34, and a secondary transfer roller 35, a secondary transfer portion T2 is formed. A recording material P is taken out, one by one, from a recording material cassette 20, and is on stand-by at a registration roller 23. The recording material P is fed by the registration roller 23 to the secondary transfer portion T2 in timing with the toner images on the intermediary transfer belt 31, and the toner images are secondary-transferred from the intermediary transfer belt 31 onto the recording material P. That is, each of the image forming portions PY, PM, PC, PK is an example of the image forming portion, and, together with the intermediary transfer belt 31, the image forming portions form the toner images on the recording material P. Thereafter, the recording material P, on which the toner images of the four colors are secondary-transferred, is fed to a fixing device 40, and is heated and pressed by the fixing device 40, so that an image is fixed on the recording material P.

In a case in which the toner images are formed on one surface (side) of the recording material P, a feeding path is switched by a flapper 61 depending on a condition. In a case in which the recording material P is discharged in a face-up state (i.e., a state in which the toner images are directed upward), the recording material P is discharged on a discharge tray 64, provided on a side surface of the image forming apparatus 1, via a discharging roller 63. In a case in which the recording material P is discharged in a face-down state (i.e., a state in which the toner images are directed downward), the recording material P is guided upward by the flapper 61, and is discharged on a discharge tray 65 provided on an upper surface of the image forming apparatus 1.

In a case in which the toner images are formed on both surfaces (sides), the recording material P, on which the toner images are fixed at one surface thereof by the fixing device 40, is guided upward by the flapper 61. The recording material P is turned upside down by being fed in a feeding path 73 in a switch-back manner, and, thereafter, the recording material P is fed through a both-surface feeding path 70, and is on stand-by at the registration roller 23. Then, the toner images are formed on the other surface of the recording material P at the secondary transfer portion T2, and are fixed by the fixing device 40, and, thereafter, the recording material P is discharged on the discharge tray 64.

The image forming portions PY, PM, PC, PK have substantially the same constitution except that the colors of the toners used in developing devices 14(Y), 14(M), 14(C), 14(K) are yellow, magenta, cyan, black, respectively, and are, therefore, different from each other. In the following description, the image forming portion PY for yellow will be described, and redundant description relating to the other image forming portions PM, PC, PK will be omitted.

At the image forming portion PY, at a periphery of a photosensitive drum 11, on which an electrostatic image is formable, a corona charger 12, an exposure device 13, the developing device 14, a transfer blade 17, and a drum cleaning device 15 are provided.

The corona charger 12 electrically charges a surface of the photosensitive drum 11 to a uniform potential. The exposure device 13 writes the electrostatic image for the image on the photosensitive drum 11 by scanning the photosensitive drum surface with a laser beam. The developing device 14 develops the electrostatic image and forms the toner image on the photosensitive drum 11. The transfer blade 17 transfers the toner image from the photosensitive drum 11 onto the intermediary transfer belt 31 by applying a voltage thereto.

Fixing Device

Figure 2:
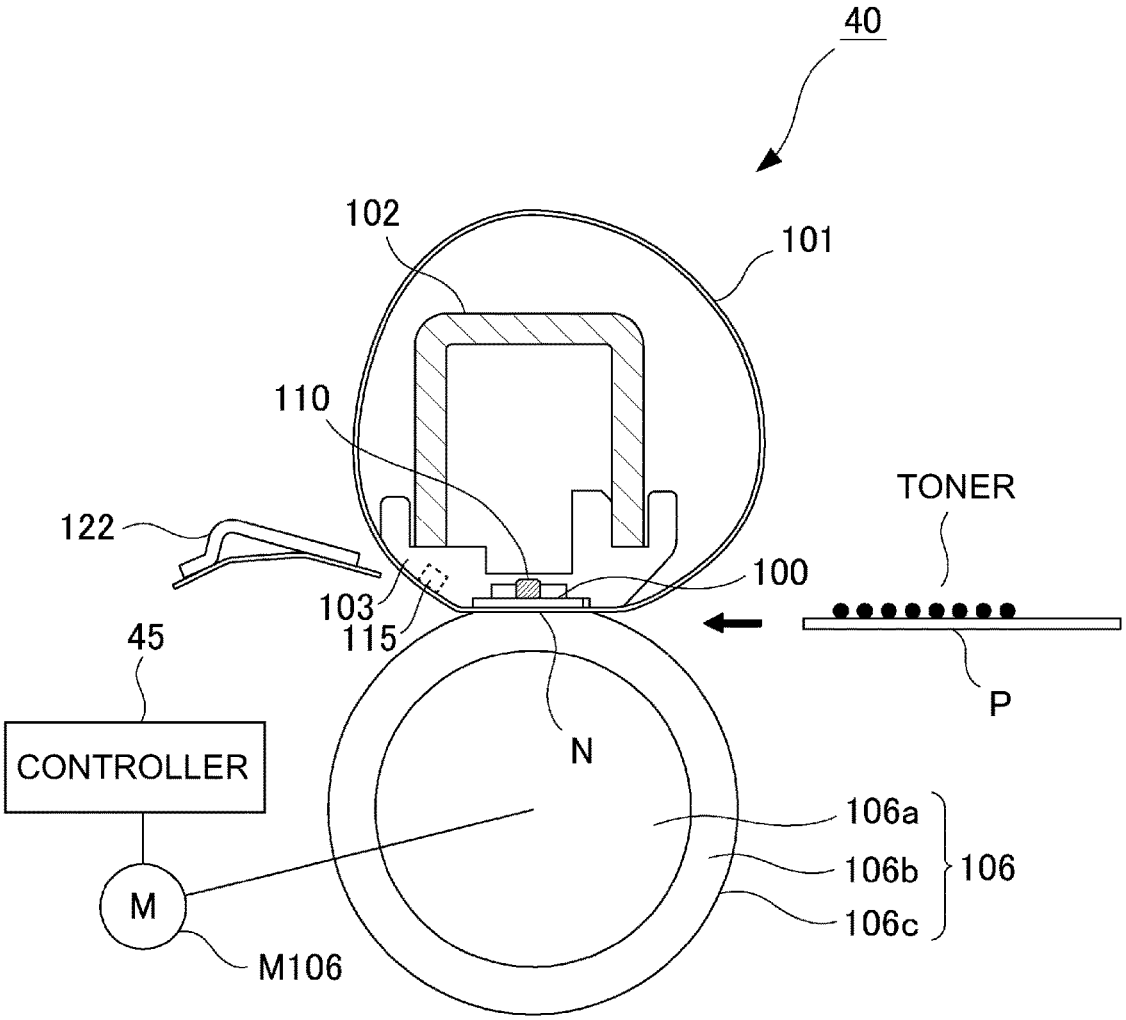
FIG. 2 is an illustration showing a structure of a fixing device taken along an axial vertical cross section.
Figure 3:
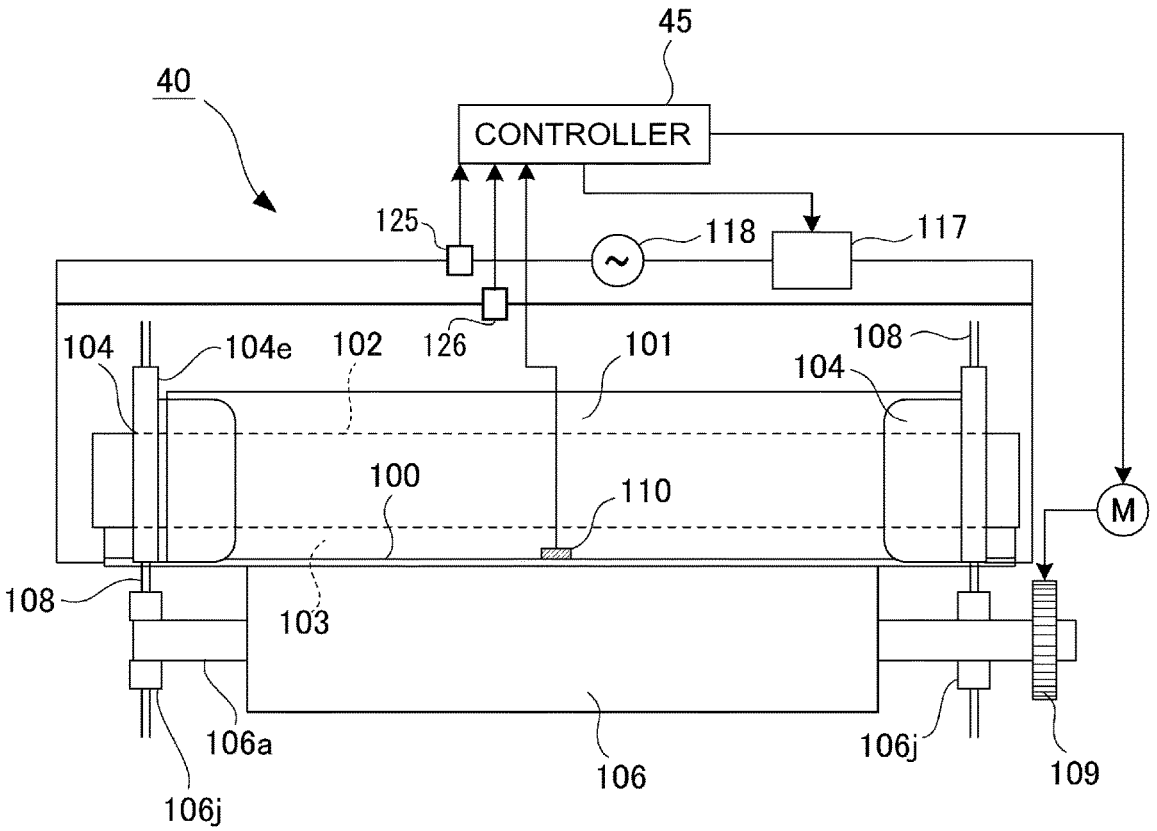
FIG. 3 is an illustration showing a structure of the fixing device as seen from a secondary transfer portion side.

FIG. 2 is an illustration showing a structure of the fixing device 40 by an axial vertical cross section. FIG. 3 is an illustration showing a structure of the fixing device 40 as seen from a secondary transfer portion side.

As shown in FIG. 2, the fixing device 40 is a fixing device of a belt heating type using an endless belt (endless belt member). The recording material P, carrying an unfixed toner image thereon, is guided along an unshown entrance guide, and is introduced into a fixing nip N. At the fixing nip N, a toner image carrying surface of the recording material P is hermetically contacted to a peripheral surface of a fixing belt 101, so that the recording material P is nipped and fed.

In a nip-feeding process at the fixing nip N, heat generated by a ceramic heater 100 is imparted to the recording material P, so that the unfixed toner image is melted and fixed on the recording material P. The recording material P passed through the fixing nip N is curvature-separated from the fixing belt 101, and, thereafter, is discharged from the image forming apparatus 1 by an unshown fixing discharging roller.

The fixing belt 101 is a cylindrical heat-resistant endless belt for conducting heat to the recording material P, and is loosely fitted around a guide member 103 to which the ceramic heater 100 is mounted. The fixing belt 101 constitutes a composite film by providing an elastic layer and a parting layer as desired on a heat-resistant base material of 100 μm or less, preferably 50 μm or less and 20 μm or more, in thickness.

For example, as the base material, a heat-conductive filler is mixed in a material principally including a resin material, such as polytetrafluoroethylene (PTFE), perfluoroalkoxy (PFA), polyimide (PI), polyamideimide (PAD, polyether ether ketone (PEEK), polyethersulfone (PES), or polyphenylene sulfide (PPS). As the base material, a thin layer metal film formed of steel use stainless (SUS), or the like, which is 50 μm or less and 20 μm or more in thickness, may also be used. The parting layer is formed by coating a fluorine-containing resin material, such as PTFE, PFA, or fluorinated ethylene propylene (FEP), on the base material. In order to obtain the color image with less unevenness, between the base material and the parting layer, an elastic layer formed of a silicone rubber, or the like, in which the heat-conductive filler is added, may also be provided.

The guide member 103 forms a guiding surface sliding with the fixing belt 101 at an inside of the rotating fixing belt 101. The guide member 103 is not only assists to ensure uniform pressure application over an entire longitudinal direction of the fixing nip N formed by press-contact between the fixing belt 101 and the pressing roller 106, but also has a function as a guide for stabilizing the rotation of the fixing belt 101.

The guide member 103 is formed of a relatively soft resin material that has a heat-resistant property and a heat-insulating property, and that has a small friction coefficient. For example, as a material having good insulating and heat-resistant properties, a material such as phenolic resin, polyimide resin, polyamide resin, polyamideimide resin, PEEK resin, PES resin, PPS resin, PFA resin, PTFE resin, or liquid crystal polymer (LCP) resin is used. A stay 102 is provided by being inserted through the fixing belt 101 in a rotational axis direction in a beam configuration, and is pressed against a back surface of the guide member 103. The stay 102 ensures strength of the guide member 103 over an entire longitudinal direction, and rectifies flexure of the guide member 103 while withstanding the pressure application of the pressing roller 106.

The pressing roller 106, which is an example of a rotatable driving member, is disposed opposite to the ceramic heater 100 via the fixing belt 101, and rotationally drives the fixing belt 101. The pressing roller 106 is formed by molding, in a roller shape, an elastic layer **106*b* concentrically and integrally around a metal core 106*a*, formed of a stainless steel rod material, and by coating a peripheral surface of the elastic layer 106*b* with a parting layer 106*c*, formed of a fluorine-containing resin material. For example, the elastic layer 106*b* is constituted by a heat-resistant elastic material, such as silicone rubber, fluorine-containing rubber, or fluorine-containing resin. As the parting layer 106*c***, it is possible to select a material having a parting property and a good heat-resistant property, such as fluorine-containing resin, silicone resin, fluoro-silicone rubber, fluorine-containing rubber, silicone rubber, PFA, PTFE, or FEP.

A separation guide 122 is provided at a position adjacent to the fixing belt 101 in a side downstream of the fixing nip N with respect to a feeding direction. At a free end position of the separation guide 122, a gap is provided so as not contact the fixing belt 101 even during the rotational drive of the fixing belt 101.

As shown in FIG. 3, the pressing roller 106 is rotatably held by a side plate 108 by mounting bearings **106*j*, formed of a heat-resistant resin, such as PEEK, PPS, or LCP, at both end portions of the metal core 106*a*. The pressing roller 106 is rotationally driven by a motor M, controlled by a controller (control portion) 45, through a gear 109 mounted at a longitudinal end portion. With the rotation of the pressing roller 106, the fixing belt 101** is rotated.

The controller 45 has a function of controlling an operation of the fixing device 40. The gear 109, mounted on the pressing roller 106, is connected with the motor M, and the motor M is rotation-controlled by the controller 45.

Fixing Flange

As shown in FIG. 3, a fixing flange 104 is fitted in the stay 102 at each end of the stay 102, and regulates orbit of the fixing belt 101 with respect to a circumferential direction while guiding an inside surface of each end of the fixing belt 101. The fixing flange 104 is engaged and held by the side plate 108, and ensures the position of the fixing belt 101.

The fixing flange 104 includes a side wall portion **104*e* abutting against each end portion of the fixing belt 101, and also functions as a thrust stopper for limiting (regulating) a longitudinal position of the fixing belt 101, and limits movement of the fixing belt 101** with respect to the rotational axis direction.

In order to smoothly rotate the fixing belt 101 by reducing a sliding frictional force of the fixing belt 101 relative to the ceramic heater 100 and the guide member 103, a lubricant is applied to an inner peripheral surface of the fixing belt 101. As the lubricant, heat-resistant oil or grease is desirable, and silicone oil, perfluoro-polyether (PFPE), fluorine-containing grease, or the like, is used.

Ceramic Heater

The ceramic heater 100 is a low-thermal capacity heating portion increasing in temperature with an abrupt rising characteristic, as a whole, by energization to a heat generating resistor. The ceramic heater 100 is fitted in and is supported by an engaging groove provided along the longitudinal direction at a lower surface of the guide member 103, and is slidable with the fixing belt 101. The ceramic heater 100 includes, on an elongated thin plate-like ceramic substrate, the heat generating resistor, a protective layer, such as a glass layer, for protecting the heat generating resistor, and an electroconductive portion connected from an electrode portion of the ceramic heater 100 to the heat generating resistor.

During image formation, the controller 45 adjusts electrical power supplied to the ceramic heater 100, so that a temperature of the ceramic heater 100 detected by a thermistor unit 110 is kept at a target temperature.

An alternating current (AC) power source 118 and an AC control circuit 117 are connected to the ceramic heater 100. The controller 45 adjusts energization to the ceramic heater 100 by controlling the AC control circuit 117 on the basis of a detected temperature Theat of the thermistor unit 110 contacted to the ceramic heater 100, and adjusts a heating output of the ceramic heater 100. The energization to the ceramic heater 100 is carried out with a setting, such that a non-energization state is 0%, a continuous energization state is 100%, and an energization ratio P % between these states is set by the controller 45. As a method of effecting the energization control at a predetermined ratio, phase control or wave number control is used.

Thermistor Unit

Figure 4:
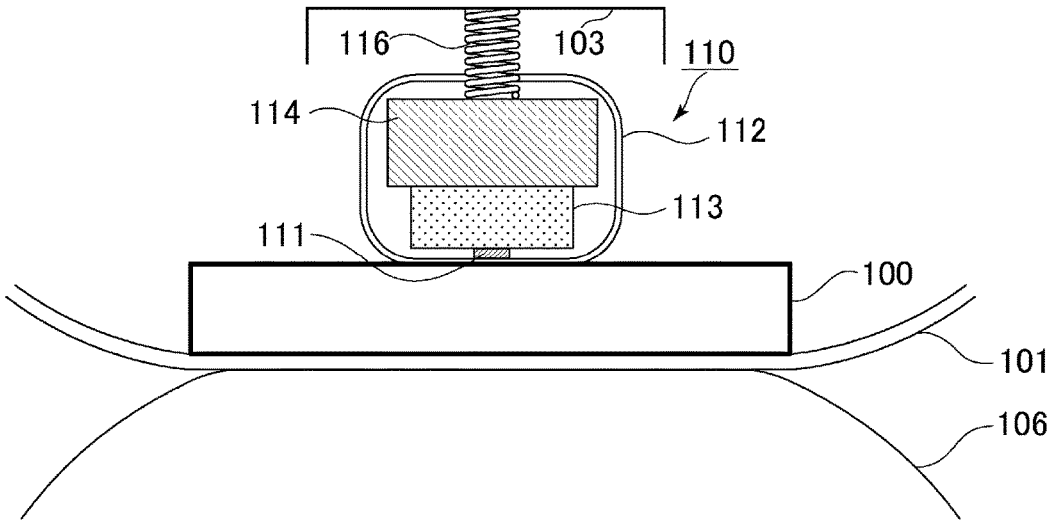
FIG. 4 is an enlarged view of a thermistor unit.

FIG. 4 is an enlarged view of the thermistor unit 110. As shown in FIG. 4, the thermistor unit 110 is disposed on a surface of the ceramic heater 100 opposite from a surface of the ceramic heater 100 where the ceramic heater 100 slides with the fixing belt 101. A thermistor 111 is a temperature detecting element changing in resistance value depending on the temperature. The thermistor 111 is electrically connected from an electrode portion thereof to a connector portion of the thermistor unit 110 by using an unshown lead wire.

A heat-resistant film 112 is formed of a polyimide film, or the like, and covers and protects the thermistor 111. A heat insulating member 113 is formed with a silicone sponge, or the like, and insulates a device peripheral portion of the thermistor 111 other than a contact surface with the ceramic heater 100, so as to increase a thermistor responsiveness. A holder portion 114 holds the heat insulating member 113. A pressing spring 116 is fixed to the guide member 103 at one end thereof, and urges the thermistor unit 110 toward the ceramic heater 100.

As described above, the thermistor unit 110, which is an example of a detecting portion, detects the temperature of the ceramic heater 100 by the thermistor unit 110. The thermistor 111, which is an example of a detecting element, is provided on the heat insulating member 113, which is an example of a heat insulator. The heat insulating member 113 is formed of a foam resin material. The heat-resistant film 112, which is an example of a resin film, is interposed between the thermistor 111 and the ceramic heater 100. The pressing spring 116, which is an example of an urging member, presses the thermistor unit 110 toward the ceramic heater 100.

Delay to Start of Heating Process

Figure 5:
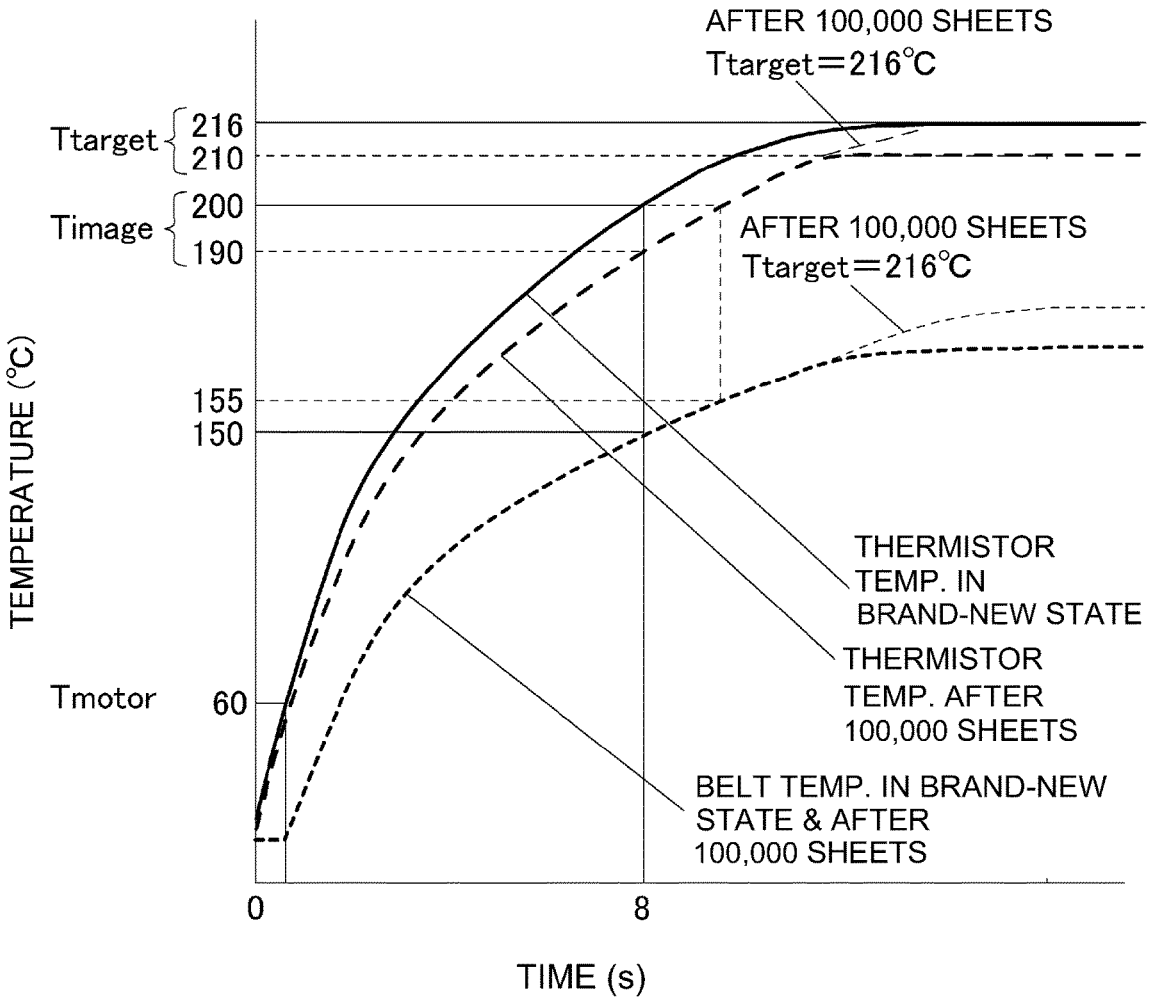
FIG. 5 is an illustration showing a lowering in responsiveness of the thermistor unit.
Figure 6:
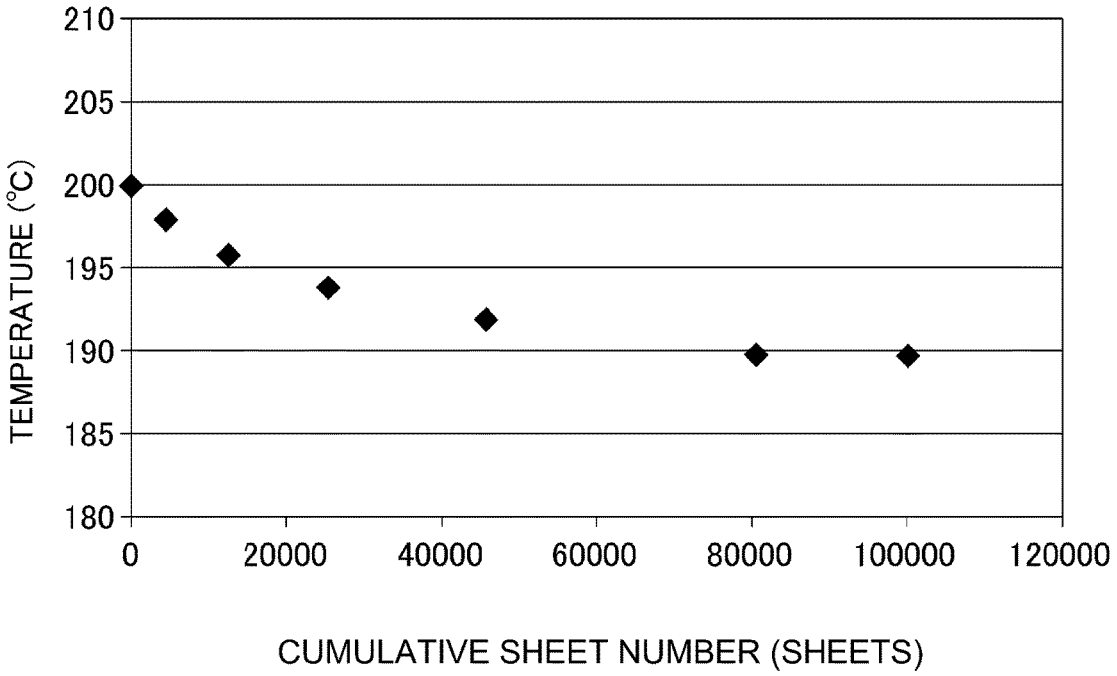
FIG. 6 is an illustration showing a relationship between a thermistor detection temperature and a cumulative sheet number (cumulative number of sheets) after eight seconds from a start of energization.

FIG. 5 is an illustration showing a responsiveness lowering of the thermistor unit 110. FIG. 6 is an illustration showing a relationship between a thermistor detection temperature and a cumulative sheet number after eight seconds from a start of the energization. Temperature rise curves in FIG. 5 show a comparison of temperature rise processes of fixing devices 40 actuated under the same environmental condition and the same device condition between a brand-new state of the thermistor unit 110 and a state in which image formation is effected on a cumulative sheet number of 100,000 sheets.

As shown in FIG. 5, in the fixing device 40, the toner image formation at the image forming portions PY, PM, PC, and PK is started at a stage in which a thermistor detection temperature Theat reaches a threshold temperature Timage of image formation start, without awaiting until the thermistor detection temperature Theat reaches a target temperature Ttarget. That is, the image formation is started in the temperature rise process before the thermistor detection temperature Theat reaches the target temperature Ttarget, and a surface temperature of the fixing belt 101 is temperature-controlled to a certain value. For this reason, when a heating process of the recording material P, on which the toner images are transferred, is started, the thermistor detection temperature Theat reaches the target temperature Ttarget.

Here, the start of the image formation means that writing of the electrostatic image on the photosensitive drum 11 is started by the exposure device 13 at the most upstream image forming portion, i.e., the yellow image forming portion PY. The start of the image formation may also be replaced, however, with a start of the charging of the photosensitive drum 11 by the corona charger 12. In either case, when the image formation is started at the upstream image forming portion PY, at downstream image forming portions PM, PC, and PK, the image formation is similarly started at a predetermined delay time from the image formation at the image forming portion PY, so that the respective color toner images overlap with each other on the intermediary transfer belt 31.

Further, in the fixing device 40, after the start of the heating process of the recording material P, when the thermistor detection temperature Theat reaches the target temperature Ttarget, the electrical power supply to the ceramic heater 100 is controlled so that the target temperature Ttarget is maintained at a certain temperature.

Even when the thermistor unit 110 is in the brand-new state, and even in the state in which the image formation is effected on the cumulative 100,000 sheets, there is no difference between the temperature rise curves of the surface of the fixing belt 101 in a process in which the fixing belt 101 starts rotation and increases in temperature, as a whole. The surface temperatures of the fixing belt 101 from the start of the energization to eight seconds after the start of the energization show the same temperature progression irrespective of the old state and the new state of the thermistor unit 110 (short dashed line in FIG. 5).

Compared with the temperature rise curve of the thermistor detection temperature Theat in the brand-new state (solid line in FIG. 5), however, the temperature rise curve of the thermistor detection temperature Theat in the state in which the image formation is effected on the cumulative 100,000 sheets (long dashed line in FIG. 5) is gentle in slope. After eight seconds from the energization start, the thermistor detection temperature Theat in the brand-new state reaches 200° C., and, on the other hand, the thermistor detection temperature Theat in the state in which the image formation is effected on the cumulative 100,000 sheets only reaches 190° C. Such a lowering in responsiveness of the thermistor unit 110 with accumulation of the image formation would be considered to be caused by an increase in a heat transfer amount through the heat insulating member 113 due to collapse of the heat insulating member 113, shown in FIG. 4, and penetration of the lubricant into the heat insulating member 113.

The lowering in responsiveness of the thermistor unit 110 with the accumulation of the image formation has an influence on timing of starting the heating process of the recording material P. In the fixing device 40, at a stage in which the thermistor detection temperature Theat in the brand-new state reaches the threshold temperature Timage=200° C., the heating process of the recording material P is started. For this reason, in the state in which the image formation is effected on the cumulative 100,000 sheets, when the recording material heating process is started at the stage in which the thermistor detection temperature Theat reaches the threshold temperature Timage=200° C., the start of the recording material heating process is delayed by two seconds. Further, the temperature of the fixing belt 101 when the recording material heating process is started is 155° C. when the thermistor unit 110 is in a used state (i.e., image forming has been effected on the cumulative 100,000 sheets), which is greater than the temperature of the fixing belt 101 when the recording material heating process is started, i.e., 150° C., when the thermistor unit 110 is in the brand-new state.

For this reason, in a case in which the threshold temperature Timage is made constant irrespective of the cumulative sheet number in the heating process, the start of the recording material heating process is gradually delayed with an increase in the cumulative sheet number in the heating process by the fixing device 40, so that the temperature of the fixing belt 101 increases little by little.

FIG. 6 is a measurement result of the thermistor detection temperature Theat measured after eight seconds from the energization start at each of stages of the cumulative sheet number indicated by ♦ when the fixing device 40 is used from the brand-new state until the cumulative sheet number in the heating process reaches 120,000 sheets. As shown in FIG. 6, in the fixing device 40, a large change in responsiveness generates in a relatively early stage from the brand-new state, and the responsiveness is stabilized at about 80,000 sheets, so that a further change in responsiveness does not generate.

Therefore, the controller 45 changes, as shown in Table 1, the threshold temperature Timage depending on the cumulative sheet number in the heating process. Further, when the cumulative sheet number in the heating process exceeds 80,000 sheets, the threshold temperature Timage is made constant. As a result, even when the responsiveness of the temperature detection by the thermistor unit 110 changes, a delay of image formation start timing and temperature rise of the fixing belt 101 at the time of the image formation start are avoided.

Problem of Deviation of Temperature Adjustment of Fixing Belt

As shown in FIG. 5, in the brand-new state, an actual belt surface temperature when the thermistor detection temperature Theat reaches the target temperature Ttarget=216° C. was 170° C. On the other hand, in the state in which the image formation is effected on the cumulative 100,000 sheets, the actual belt surface temperature when the thermistor detection temperature Theat reached the target temperature Ttarget=216° C. was 176° C. That is, when the control is effected at the same target temperature Ttarget=216° C., in the brand-new state, the temperature of the fixing belt 101 contacting the image surface of the recording material P is 170° C., and on the other hand, in the state in which the image formation is effected on the cumulative 100,000 sheets, the temperature of the fixing belt 101 increases up to 176° C. For this reason, in a case in which the target temperature Ttarget is made constant irrespective of the cumulative sheet number in the heating process, offset toner, which is melted and transferred onto the fixing belt 101, increases with an increase in cumulative sheet number in the heating process.

The surface temperature of the fixing belt 101 contacting a leading end of a first sheet of the recording material P in a job is determined by the threshold temperature Timage, but the surface temperature of the fixing belt 101 during a continuous heating process of the recording materials P is determined by the target temperature Ttarget. For this reason, also the target temperature Ttarget should be changed depending on the change in responsiveness of the thermistor unit 110.

Therefore, as shown in Table 1, the controller 45 changes the target temperature Ttarget depending on the cumulative sheet number in the heating process. Then, when the cumulative sheet number in the heating process exceeds 80,000 sheets, the target temperature Ttarget is made constant. As a result, even when the responsiveness of the temperature detection by the thermistor unit 110 changes, excessive temperature (rise) of the fixing belt 101 is avoided.

Incidentally, as regards the target temperature Ttarget, there is a special situation in which, as shown in FIG. 4, when the heat insulating member 113 of the thermistor unit 110 is cool, a temperature difference between a thermistor surface and a holder portion surface of the heat insulating member 113 is large, and, therefore, the heat transfer amount is largely different between the brand-new state and the state in which the image formation is effected on the cumulative 100,000 sheets. When the thermistor unit 110 is warmed, however, the temperature of an entirety of the heat insulating member 113 increases, so that the temperature difference between the thermistor surface and the holder portion surface of the heat insulating member 113 becomes small. For this reason, the heat transfer amount itself through the heat insulating member 113 becomes small, so that a difference in detected temperature of the thermistor 110 becomes small between the brand-new state and the state in which the image formation is effected on the cumulative 100,000 sheets.

Therefore, the controller 45 gradually decreases, with a lapse of the time from the energization start, a difference in target temperature Ttarget between the brand-new state and the state in which the image formation is effected on the cumulative 100,000 sheets. The controller 45 changes the difference in target temperature Ttarget depending on a temperature state of the thermistor unit 110, so that the difference is decreased when the thermistor unit 110 is warm.

Control of Embodiment 1

Figure 7:
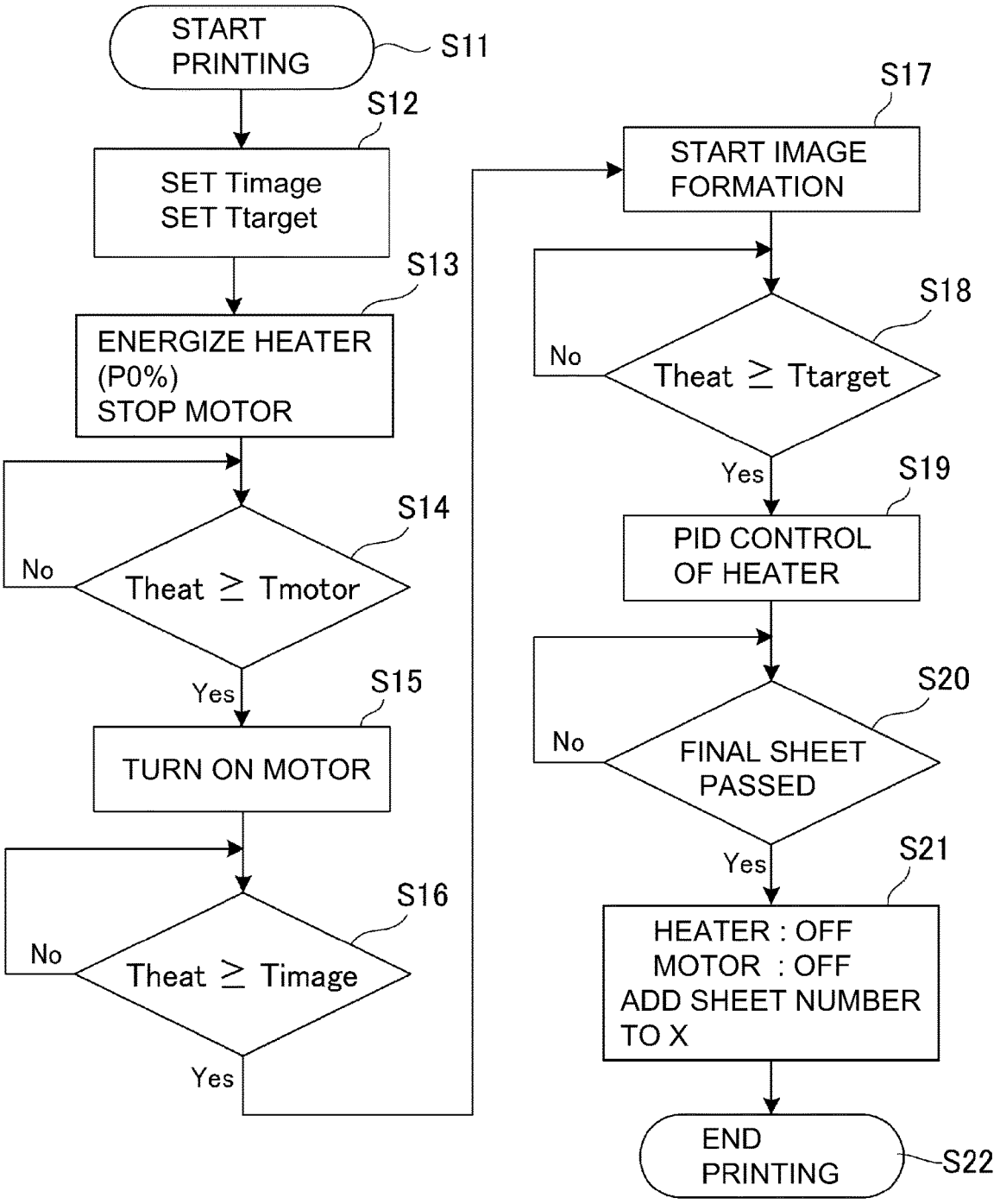
FIG. 7 is a flowchart showing control in Embodiment 1.

FIG. 7 is a flowchart of control of Embodiment 1. As shown in FIG. 7, when a printing start instruction is received (S11), the controller 45 determines the threshold temperature Timage and the target temperature Ttarget depending on a count value X of an integral sheet number counter for counting the cumulative sheet number in the heating process (S12). The integrated sheet number counter (ISNC), which is an example of a counting portion, is formed in the controller 45 and counts and stores a sheet number (i.e., a cumulative sheet number corresponding to the number of sheets subjected to the fixing process, a cumulative sheet number corresponding to a number of output images, a cumulative number of times of image exposure, or the like) of the recording materials P on which the toner images are formed.

TABLE 1

| ISNC*[1] X (SHEETS) | Timage (° C.) | Vth (V) at Timage | Ttarget (° C.) | Vth (V) at Ttarget |
|---|---|---|---|---|
| 0 ≤ N < 4000 | 200 | 1.702 | 216 | 1.498 |
| 4000 ≤ N < 12000 | 198 | 1.730 | 215 | 1.509 |
| 12000 ≤ N < 25000 | 196 | 1.756 | 214 | 1.522 |
| 25000 ≤ N < 45000 | 194 | 1.783 | 213 | 1.535 |
| 45000 ≤ N < 80000 | 192 | 1.811 | 212 | 1.548 |
| 80000 ≤ N | 190 | 1.837 | 210 | 1.572 |

*[1]"ISNC" is the integrated sheet number counter.

A table of Table 1 is stored in advance as data in a memory (storing portion) incorporated in the controller 45. The controller 45 changes, as shown in Table 1, the threshold temperature Timage and the target temperature Ttarget depending on the integrated sheet number counter X. As a result, even when the lowering in responsiveness of the thermistor unit 110 generates in accordance with an operation sheet number of the fixing device 40, as shown in FIG. 6, it is possible to avoid delay of an image formation start (S17).

Incidentally, in the table of Table 1, the target temperature Ttarget is adjusted so that the difference depending on the cumulative sheet number in the heating process decreases depending on a lapse of a time from the energization start, as described above.

Further, in the table of Table 1, Vth is a thermistor sharing voltage when a reference voltage is applied to a circuit in which the thermistor 111 and an unshown reference resistor are connected in series.

Further, in Embodiment 1, the operation sheet number of the fixing device 40 is used as a cumulative operation parameter of the fixing device 40. In a case in which a fixing operation time per (one) sheet changes by a change in an output sheet number during a single printing operation, however, a driving time (heating process time) of the fixing device 40 may also be used as the cumulative operation parameter of the fixing device 40. In a case in which a fixing (device) driving speed is different depending on the kind of the recording material P, a cumulative rotational frequency of the fixing belt 101 or of the pressing roller 106 may be used as the cumulative operation parameter of the fixing device 40.

In a modified embodiment in which the heating process time is measured, the controller 45, which is an example of a measuring portion, measures a cumulative time in which the recording material P is heated by the fixing belt 101. The controller 45 starts the image forming operation at timing when a temperature, corresponding to an output of the thermistor 110 when the measured cumulative time is a first time, is a first temperature. Then, the controller 45 starts the image forming operation at a timing when a temperature, corresponding to an output of the thermistor 110 when the measured cumulative time is a second time that is greater than the first time, is a second temperature that is less than the first temperature.

After the threshold temperature Timage and the target temperature Ttarget are determined, the controller 45 starts energization to the ceramic heater 100 at an energization ratio P0% (S13). At this time, the motor M is kept in the rest state.

When the thermistor detection temperature Theat reaches a motor driving temperature Tmotor (Yes in step S14), the controller 45 starts drive of the motor M and rotates the pressing roller 106 and the fixing belt 101 (S15). By the drive of the motor M, the pressing roller 106 is rotationally driven, so that the fixing belt 101 is driven with the rotation of the pressing roller 106.

The controller 45, which is an example of a control portion, controls, depending on the output of the thermistor 110, a timing when the image forming operation by the image forming portions PY, PM, PC, and PK is started. When the thermistor detection temperature Theat reaches the threshold temperature Timage (Yes in step S16), the controller 45 starts the image formation (imaging) (S17). When the recording material P, on which the toner images T are transferred, reaches the fixing device 40, it is estimated that the thermistor detection temperature Theat reaches the target temperature Ttarget, and writing of the electrostatic latent image for the image by the exposure device 13 is started in advance. After the start of formation of the electrostatic latent image, the unfixed toner image T is transferred onto the recording material P, and the recording material P, on which the unfixed toner image T is carried, is guided to the fixing nip N along the entrance guide (not shown), so that the image is fixed.

Then, when detection by the thermistor 111 indicates that the thermistor detection temperature Theat is not less than the target temperature Ttarget (Yes in step S18), the controller 45 switches the control of the energization to the ceramic heater 100 to proportion-integral-derivative (PID) control, so that the target temperature Ttarget is maintained (S19).

After a final recording material P, in a series of printing operations has passed through the fixing nip N (Yes in step S20), the controller 45 stops the energization to the ceramic heater 100 and stops the motor M, and adds the number of sheets passed by the series of printing operations to the integrated sheet number counter X (S21).

In Embodiment 1, as shown in Table 1, the threshold temperature Timage is stepwisely changed correspondingly to the increase in a cumulative sheet number in the heating process. As a result, for example, as shown in FIG. 5, in a case in which the threshold temperature Timage is set at 200° C. in the brand-new state, after the cumulative 100,000 sheets, Timage is set at 190° C. As a result, the surface temperature of the fixing belt 101 at the time of the image formation start (S17) is uniformized at 150° C., so that a heating amount with respect to the recording material P at the time of the start of the heating process can be reproduced every time at a substantially certain value.

Comparison Example 1

In Comparison Example 1, as shown in Japanese Laid-Open Patent Application No. 2014-59549, to resolve a problem in which the responsiveness of the thermistor lowers during use of the fixing device, detected temperatures are mutually corrected using a plurality of the thermistors. In Comparison Example 1, however, in the case in which the responsiveness is lowered similarly with accumulation of the heating process by the plurality of the thermistors, the correction of the detected temperatures is not carried out, and, therefore, it is difficult to prevent the temperature rise of the fixing belt at the time of the start of the heating process due to the lowering in responsiveness.

Comparison Example 2

In Comparison Example 2, as shown in Japanese Laid-Open Patent Application No. 2002-351254, the temperature detecting surface of the thermistor element is covered with a porous film in which a silicone oil, or the like, is contained, and the porous film is press-contacted together with the thermistor element to the fixing belt, so that deposition of contamination on the thermistor element is prevented. In Comparison Example 2, however, an oil amount at a portion in the neighborhood of the thermistor element has an influence on the responsiveness of the thermistor, and, therefore, a variation in temperature of the fixing belt at the time of the start of the heating process due to the lowering in responsiveness is rather amplified. In order to maintain the oil amount at the portion in the neighborhood of the thermistor element at a certain value, it would be considered that a constitution of stably supplying an oil to the porous film is provided, but this causes an increase in cost and is not preferable.

Effect of Embodiment 1

In Embodiment 1, as shown in Table 1, when the counted sheet number of the recording materials P is 2,000 sheets, as an example of a first sheet number, the image forming operation is started at timing when the temperature corresponding to the output of the thermistor unit 110 is 200° C. When the sheet number of the recording materials P is 80,000 sheets, as an example of a second sheet number, and is, therefore, more than 2,000 sheets, the image forming operation is started at timing when the output temperature is 190° C., which is an example of a second temperature that is less than a first temperature. For this reason, even when the cumulative sheet number of the image formation increases, the image formation can be started in a state in which the temperature difference of the fixing belt 101 is small.

In Embodiment 1, as shown in FIG. 6, a lowering amount per increase amount of the counted sheet number at the output temperature when the image forming operation is started is made to be greater when the counted sheet number is a third sheet number than when the counted sheet number is a fourth sheet number that is greater than the third sheet number. Then, the output temperature when the image forming operation is started is made constant when the counted sheet number exceeds a fifth sheet number that is greater than the third sheet number. That is, a lowering amount of the threshold temperature Timage per 10,000 sheets at an initial stage of a lifetime of the fixing device 40 is made to be greater than the lowering amount of the threshold temperature Timage per 10,000 sheets at a middle stage of the lifetime of the fixing device 40. For this reason, it is possible to correct the threshold temperature Timage along a change in responsiveness of the thermistor 111 with a cumulative amount of the recording material heating process.

In Embodiment 1, as shown in Table 1, the target temperature Ttarget is made to be less when the cumulative sheet number of the recording materials P subjected to the image formation is 80,000 sheets than when the cumulative sheet number is 2,000 sheets. For this reason, irrespective of the cumulative amount of the recording material heating process, in a state in which the temperature difference of the fixing belt 101 is small, it is possible to continue the recording material heating process at several tens of thousands of sheets, and later.

In Embodiment 1, in the fixing device 40, when the recording material P is heated using the thermistor unit 110 including the thermistor 111, the fixing belt 101 can be controlled in a predetermined temperature range. The heating of the recording material P is started in a state in which the detected temperature of the thermistor unit 110 is lower with the accumulation of the heating process. Even when the responsiveness of the thermistor unit 110 lowers with the accumulation of the heating process and a difference between the detected temperature and the temperature of the fixing belt 101 becomes large, the temperature of the fixing belt 101 at the time of the start of the heating process is reproduced every time at a substantially certain value. For this reason, excessive heating of the recording material P due to an excessive temperature of the fixing belt 101 is suppressed, so that it is possible to avoid a situation in which the toner is liable to be transferred onto the fixing belt 101 due to the excessive heating of the recording material P.

Embodiment 2

Figure 8:
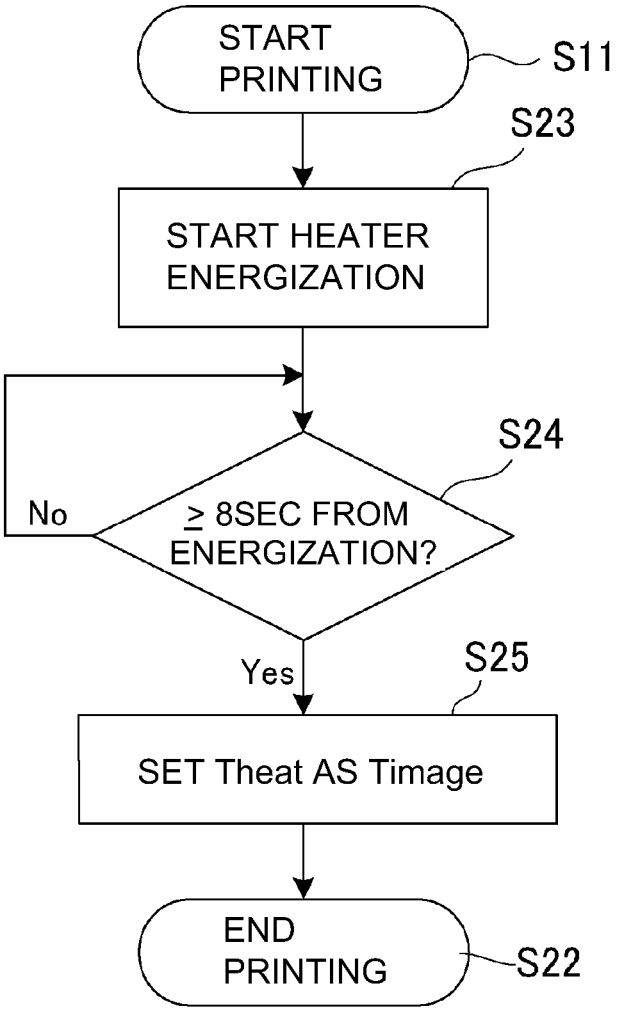
FIG. 8 is a flowchart showing a setting mode in Embodiment 2.

FIG. 8 is a flowchart of a setting mode in Embodiment 2. In Embodiment 1, the threshold temperature Timage was set on the basis of the table recorded in advance in the memory (storing portion) incorporated in the controller 45. On the other hand, in Embodiment 2, in parallel to a sequence of Embodiment 1 shown in FIG. 7, as shown in FIG. 8, (an operation in) the setting mode for actually measuring the responsiveness of the thermistor unit 110 is executed and the threshold temperature Timage is set. Accordingly, in Embodiment 2, using a constitution similar to the constitution of Embodiment 1, control is effected similarly as in Embodiment 1 except for the setting mode. Incidentally, in Embodiment 2, the target temperature Ttarget was the certain value irrespective of the cumulative sheet number in the heating process.

As shown in FIG. 8, when a printing start instruction is received (S11), the controller 45 executes the setting mode and determines the threshold temperature Timage. The controller 45 measures the thermistor detection temperature Theat after eight seconds (Yes in step S24) from a start of energization (S23) to the fixing device 40 (S25). Further, a current measured value of the thermistor detection temperature Theat after eight seconds is set at the threshold temperature Timage at the time of a subsequent energization start (S25).

Embodiment 3

Figure 9:
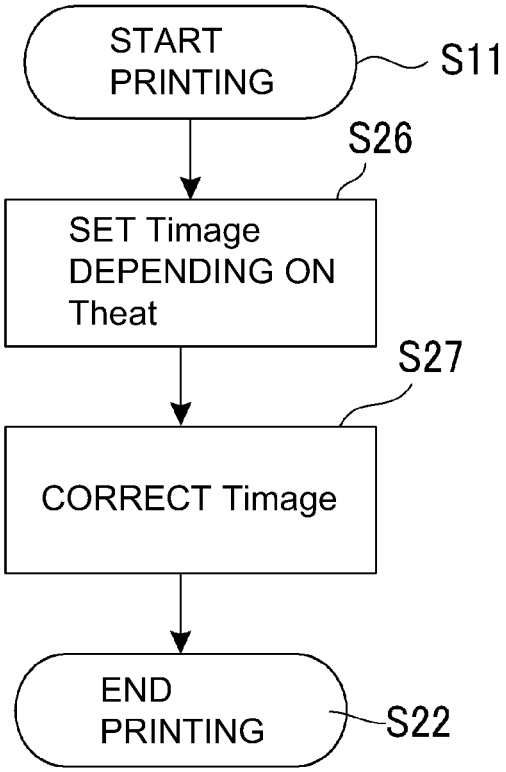
FIG. 9 is a flowchart showing a setting mode in Embodiment 3.

FIG. 9 is a flowchart of a setting mode in Embodiment 3. In Embodiment 1, when the cumulative sheet number in the heating process was the same, the same threshold temperature Timage was set. On the other hand, in Embodiment 3, in the control in Embodiment 1, even when the cumulative sheet number in the heating process of the fixing device 40 is the same, in the case a case in which a thermistor detection temperature Tstart at the time of a printing start is different, the threshold temperature Timage is changed.

In a state in which a time has not so elapsed from the last stop of the fixing device 40 and the fixing device 40 is sufficiently warmed, as shown in FIG. 4, a temperature difference between upper and lower surfaces of the heat insulating member 113 is small. For this reason, even when a heat-insulating property of the heat insulating member 113 lowers with the accumulation of the heating process and the responsiveness of the thermistor 111 lowers, the temperature difference between the fixing belt 101 (ceramic heater 100) and the thermistor detection temperature Theat is small. In such a condition, as shown in FIG. 5, even when the heating process is cumulatively performed with respect to 100,000 sheets, a temperature rising curve is close to a solid line in the brand-new state, and, therefore, there is no need to lower the threshold temperature Timage to 190° C.

Therefore, in Embodiment 3, as shown in FIG. 9, depending on the thermistor detection temperature Theat when the printing start is received (S26), the threshold temperature Timage set in Embodiment 1 or Embodiment 2 is stepwisely corrected (S27).

TABLE 2

| DTDA*1 | Timage (° C.) |
|---|---|
| ≥150° C. | 200 |
| ≥100° C. & <150° C. | IV*2 |
| <100° C. | RT*3 |

*1"DTDA" is the detected temperature during actuation.
*2"IV" is an intermediate value between respective temperatures in Table 1 and 200° C.
*3"RT" is respective temperatures in Table 1.

As shown in Table 2, the controller 45 makes the threshold temperature Timage greater when the output temperature at the time of the energization start of the ceramic heater 100 is 150° C., as an example of a third temperature, than when the output temperature is 99° C., as an example of a fourth thermistor that is less than 150° C. As a result, even in the case in which the last image formation is ended and subsequent image formation is started immediately after the image forming apparatus 1 is stopped, an actual temperature of the fixing belt 101 when the image formation is started is prevented from becoming high.

Embodiment 4

Figure 10:
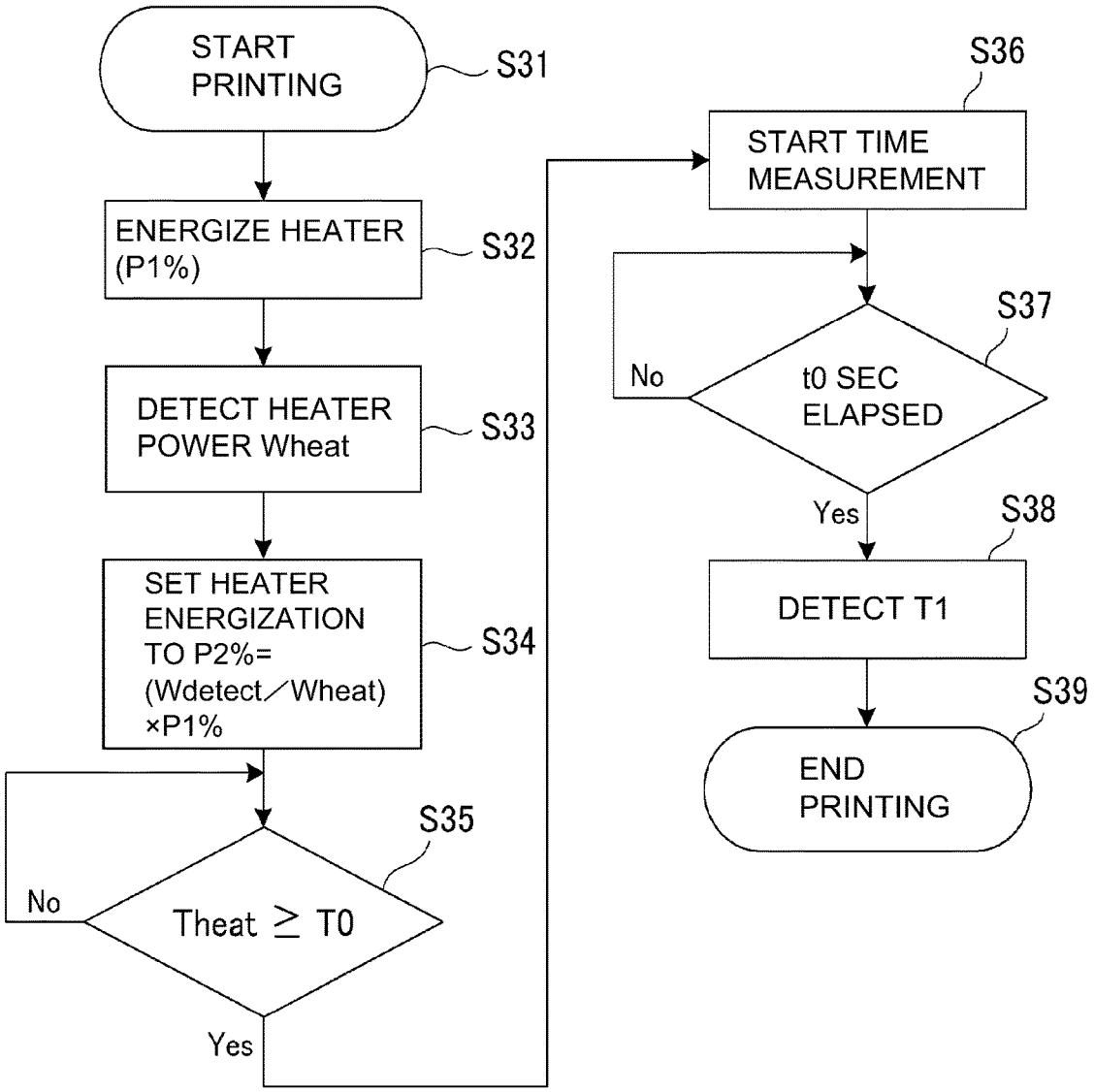
FIG. 10 is a flowchart showing control in Embodiment 4.

FIG. 10 is a flowchart of a setting mode in Embodiment 4. Even in the thermistor unit 110 in Embodiment 1, the responsiveness of the thermistor 111 abruptly changes in some cases by a deviation of a contact state during use and movement of the oil or grease, used for reducing the friction force with the fixing belt 101, around the neighborhood of the thermistor 111. In this case, in the control in which the continuous change in responsiveness as shown in FIG. 6 is assumed, it is difficult to set a proper threshold temperature and a proper target temperature.

Therefore, in Embodiment 4, as shown in FIG. 3, the setting mode is executed in a period from the energization start of the fixing device 40 until the thermistor detection temperature Theat reaches the threshold temperature Timage, so that the threshold temperature Timage is set. In the setting mode, the threshold temperature Timage is set depending on a thermistor response temperature T1 after t0 seconds from a start of supply of certain detecting electrical power Wdetect to the ceramic heater 100.

Here, a temperature rise curve of the thermistor detection temperature Theat of the thermistor unit 110 when the ceramic heater 100 is energized changes depending on a heat generation amount per unit time of the ceramic heater 100. When the heat generation amount per unit toner is large, temperature rise becomes fast, and, when the heat generation amount per unit time is small, the temperature rise becomes slow. The heat generation amount per unit time of the ceramic heater 100 changes depending on an output voltage of the AC power (voltage) source 118, an energization ratio P % controlled by the AC control circuit 117, and a resistance value of the heat generating member of the ceramic heater 100. For this reason, due to a variation in resistance value of the ceramic heater 100 and a fluctuation in output voltage of the AC power source 118, there is a possibility of generation of an error in threshold temperature Timage set in the setting mode. The resistance value of the ceramic heater 100 causes the variation for each of portions of the fixing device 40, and also the output voltage of the AC power source 118 causes the fluctuation and variation in a commercial power source.

Therefore, in Embodiment 4, the setting mode is executed during actuation of the fixing device 40, so that the proper threshold temperature Timage is determined independently of a current value of the cumulative sheet number in the heating process. In the responsiveness measuring mode, the supplied electrical power and a detected temperature rise amount of the thermistor unit 110 are measured under energization to the ceramic heater 100, so that a change in responsiveness of the detected temperature by the thermistor unit 110 is discriminated. For that purpose, electrical power detecting portions 125, 126 for detecting the electrical power under energization to the ceramic heater 100 were provided.

The electrical power detecting portions 125, 126 include a current detecting circuit 125 for detecting a current of the ceramic heater 100 during the energization and a voltage detecting circuit 126 for detecting a voltage of the ceramic heater 100 during the energization, and the controller 45 acquires electrical power by multiplying the detected current and voltage together. The electrical power detecting portions 125, 126 may also detect and calculate one of the voltage and the current, which are applied to the ceramic heater 100, after the resistance value of the ceramic heater 100 is stored in advance in the controller 45. As a method of measuring the supplied electrical power, a method of detecting the current and the voltage during the energization to the ceramic heater 100, and a method in which the resistance value of the ceramic heater 100 is stored in advance and one of the voltage and the current that are applied to the ceramic heater 100 is measured to acquire the electrical power exist.

Control in Embodiment 4

Figure 11:
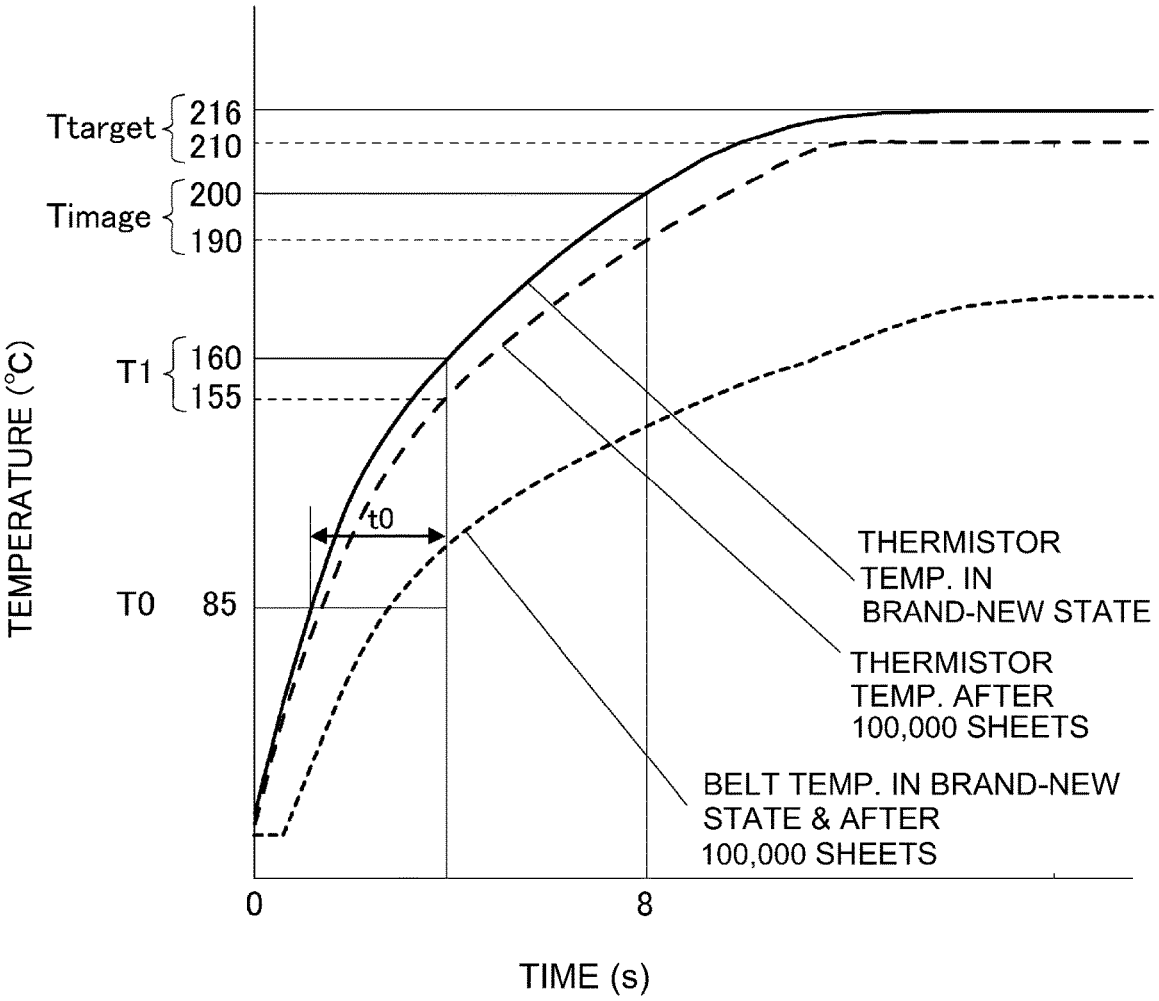
FIG. 11 is an illustration showing the control in Embodiment 4.

FIG. 10 is the flowchart of control in Embodiment 4. FIG. 11 is an illustration showing the control in Embodiment 4. As shown in FIG. 10, and with reference to FIG. 3, when printing is started (S31), the controller 45 starts energization to the ceramic heater 100 at a predetermined energization ratio P1% (S32). Thereafter, the controller 45 detects heater electrical power Wheat during the energization by the above-described electrical power detecting portions 125, 126 (S33).

When the heater electrical power Wheat is detected, the controller 45 starts supply of predetermined detecting electrical power Wdetect to the ceramic heater 100 (S34). The controller 45 sets the energization ratio of the energization to the ceramic heater 100 at P2%, defined below, so that the detecting electrical power Wdetect is constant even when the resistance value of the ceramic heater 100 and the output voltage of the AC power source 118 change or vary (S34):

$$P2\% = (W\text{detect}/W\text{heat}) \times P1(\%).$$

The controller 45 makes the detecting electrical power Wdetect, supplied to the ceramic heater 100, a certain value by using the heater electrical power Wheat detected during the P1% energization, which is the energization ratio for outputting the detecting electrical power Wdetect to the ceramic heater 100.

As shown in FIG. 11, when certain electrical power is supplied to the ceramic heater 100, a slope of thermistor detection temperature Theat/time at each time after the energization is started is reproduced at a certain level. The controller 45 detects the change in thermistor detection temperature Theat when the fixing belt 101 increases by a predetermined temperature, so that the controller 45 discriminates the responsiveness of the thermistor unit 110.

After, the supply of the detecting electrical power Wdetect to the ceramic heater 100 is started, the controller 45 starts time measurement (counting) using, as a trigger, timing when the thermistor detection temperature Theat of the thermistor unit 110 detected a predetermined temperature T0 (YES in step S35) (S36).

The controller 45 measures a thermistor response temperature T1 at the time when T0 seconds has elapsed from the start of counting (YES in step S37) (S38). The controller 45 discriminates the responsiveness of the thermistor unit 110 by using the thermistor response temperature T1 and can set the proper threshold temperature Timage. Table 3 is a threshold temperature Timage setting table in the case in which setting is not made depending on the integrated sheet number, but is made by carrying out (the operation in) the setting mode in the fixing device having the constitution of Embodiment 1.

TABLE 3

| T1 | Timage (° C.) | Vth (V) at Timage | Ttarget (° C.) | Vth (V) at Ttarget |
|---|---|---|---|---|
| T1 ≥ 160 | 200 | 1.702 | 216 | 1.498 |
| 160 > T1 ≥ 159 | 198 | 1.730 | 215 | 1.509 |

TABLE 3-continued

| T1 | Timage (° C.) | Vth (V) at Timage | Ttarget (° C.) | Vth (V) at Ttarget |
|---|---|---|---|---|
| 159 > T1 ≥ 158 | 196 | 1.756 | 214 | 1.522 |
| 158 > T1 ≥ 157 | 194 | 1.783 | 213 | 1.535 |
| 157 > T1 ≥ 156 | 192 | 1.811 | 212 | 1.548 |
| 156 > T1 | 190 | 1.837 | 210 | 1.572 |

As shown in Table 3, the controller 45 discriminates that the responsiveness of the thermistor unit 110 is greater with a higher thermistor response temperature T1, and sets the threshold temperature Timage and the target temperature Ttarget at high temperatures. On the other hand, the controller 45 discriminates that the responsiveness of the thermistor unit 110 is less with a lower thermistor response temperature T1, and sets the threshold temperature Timage and the target temperature Ttarget at low temperatures.

As shown in FIG. 7, during the printing operation after the setting, the start of the heating process is controlled using the threshold temperature Timage acquired in the setting mode, so that the temperature of the fixing belt 101 is controlled using the target temperature Ttarget.

Incidentally, in the setting mode, in a period from detection of the predetermined temperature T0 until t0 seconds has elapsed, in order to stabilize heat effluence of the ceramic heater 100, the motor M may desirably be in a rest state or may be operated at a certain speed.

As described above, in Embodiment 4, as shown in FIG. 11, the controller 45 measures an output of the thermistor unit 110 after a lapse of a predetermined time (after t0 seconds) from the time when the output temperature is a first temperature (85° C.) in a state in which predetermined electrical power is supplied to the heating portion. The controller 45 starts the image forming operation at timing when the output temperature, at a time when the measured output temperature of the thermistor unit 110 is the second temperature 160° C., is the third temperature (200° C.). When the output temperature is the fourth temperature 155° C. that is less than 160° C., however, the controller 45 starts the image forming operation at a timing when the output temperature is a fifth temperature (190° C.) that is less than 200° C. For this reason, it is possible to correct the threshold temperature Timage while also following an unexpected change in responsiveness of the thermistor 111.

Incidentally, in Embodiment 4, the rise amount of the detected temperature of the thermistor 111, when the predetermined electrical power supplying state was continued for a predetermined time, was detected. In the state in which the predetermined electrical power is supplied to lamp heaters 127*a*, 127*b*, as shown in FIG. 11, however, the controller 45 may also measure a time from the output temperature being the first temperature (85° C.) to an increase to the second temperature 160° C. In this case, the image forming operation is started at timing when the output temperature, at a time when the measured time is the first time (T0 seconds), is the third temperature (200° C.). When the measured time is a second time (T0 seconds+α) that is greater than t0 seconds, the controller 45 may only be required to be started at a timing when the output temperature is the fourth temperature (190° C.) that is less than 200° C.

Embodiment 5

Figure 12:
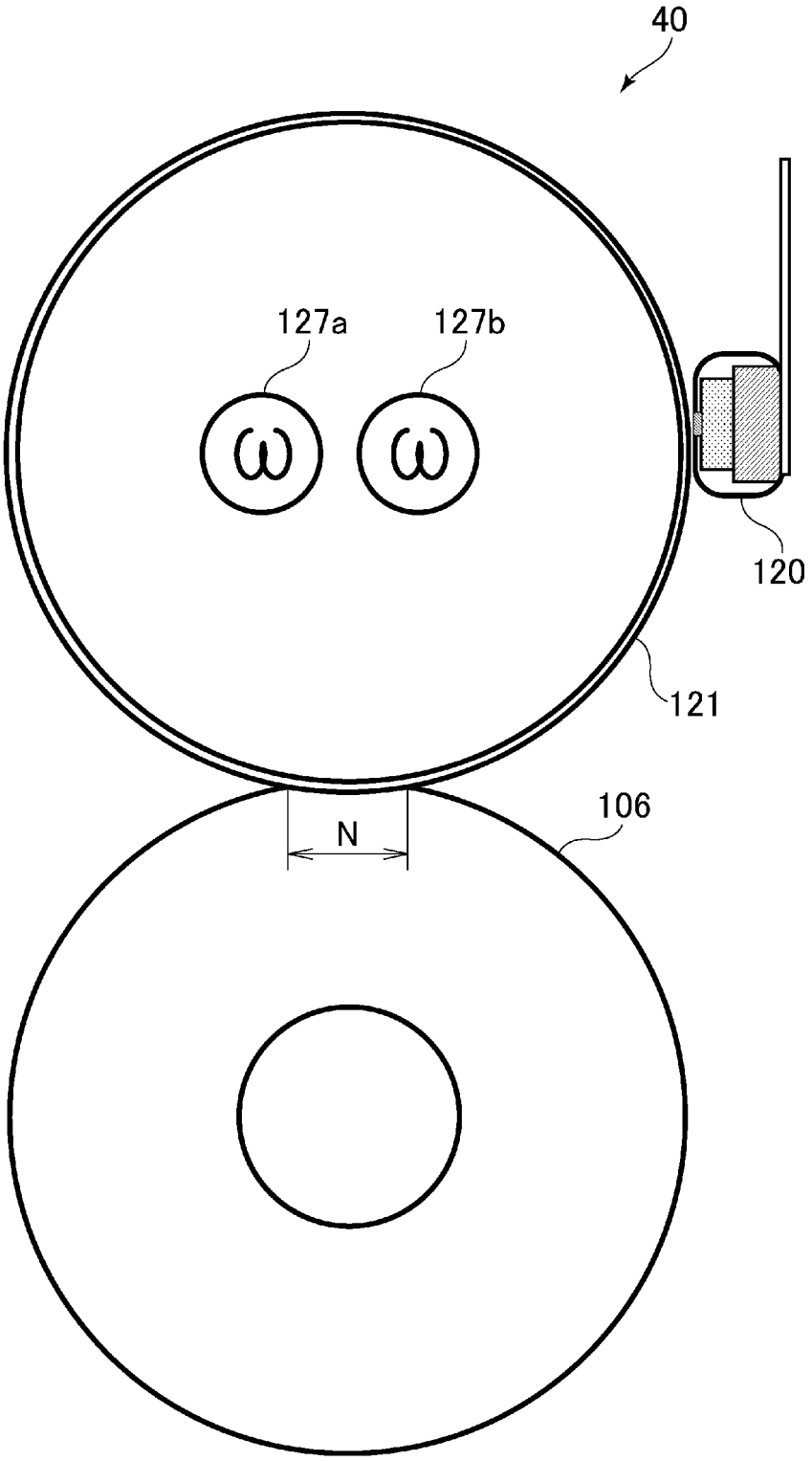
FIG. 12 is an illustration showing a fixing device of a roller heating type.
Figure 13:
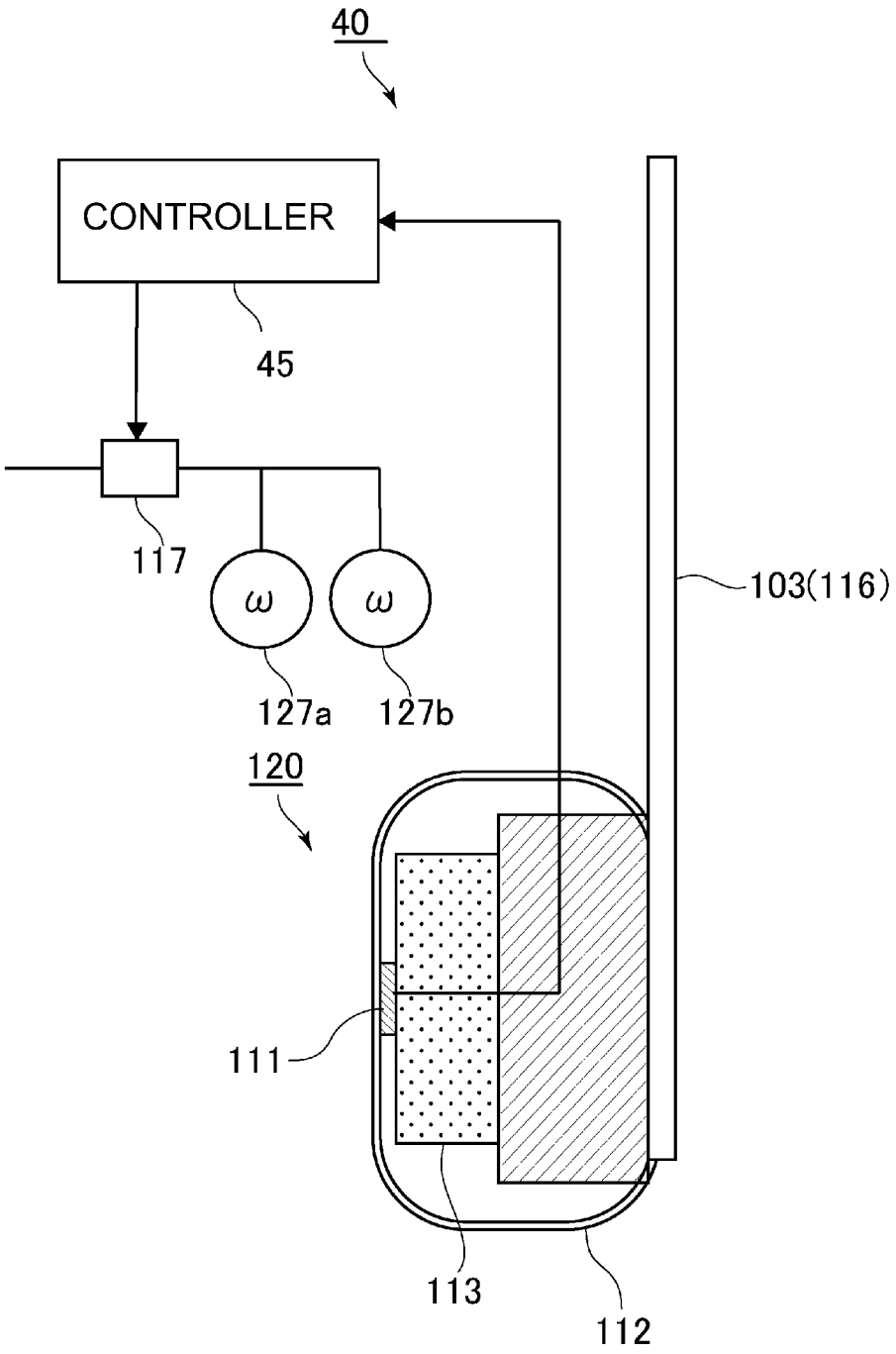
FIG. 13 is an illustration showing a thermistor unit contacted to an outer peripheral surface of a fixing roller.

FIG. 12 is an illustration showing a fixing device of a roller heating type. FIG. 13 is an illustration showing a thermistor unit 120 contacted to an outer peripheral surface of a fixing roller 121. In Embodiment 5, the fixing device 40 shown in FIG. 3 is replaced with a fixing device 40 of the roller heating type shown in FIG. 12. For this reason, in FIG. 13, constituent elements common to Embodiment 1 (and Embodiment 5) are represented by the same symbols as those in Embodiment 1 and will be omitted from redundant description.

As shown in FIG. 12, the fixing device 40 is of a roller type, in which a fixing roller 121 is heated by the lamp heaters 127*a*, 127*b* disposed in the fixing roller 121 having a hollow shape. The fixing roller 121, which is an example of a rotatable heating member, heats the toner images transferred from the intermediary transfer belt 31 onto the recording material P. The pressing roller 106, which is an example of a rotatable pressing member, presses the recording material P, on which the toner images are formed, at the nip with the fixing roller 121. Inside the fixing roller 121, the lamp heaters 127*a*, 127*b* are disposed non-rotationally. The lamp heaters 127*a*, 127*b*, which are an example of a heating portion, heat the fixing roller 121.

As shown in FIG. 12, the fixing roller 121 is temperature-detected by the thermistor unit 120 contacted to a peripheral surface of the fixing roller 121.

As shown in FIG. 13, the thermistor unit 120 is provided for carrying out temperature control of the fixing roller 121 and detects the temperature of the fixing roller 121. The controller 45 controls electrical power supply to the lamp heaters 127*a*, 127*b* so that the detected temperature converges to the target temperature. Heating outputs of the lamp heaters 127*a*, 127*b* are controlled so that the thermistor detection temperature Theat of the thermistor unit 120 is maintained at the target temperature Ttarget.

The controller 45 controls timing when the image forming operation by the image forming portions PY, PM, PC, and PK is started depending on a temperature corresponding to an output of the thermistor unit 120. After the electrical power supply to the lamp heaters 127*a*, 127*b* is started, the controller 45 starts the image formation when the detected temperature of the thermistor 111 reaches the threshold temperature Timage less than the target temperature Ttarget.

As shown in FIG. 13, in the fixing device 40, the thermistor 111 is supported by the heat insulating member 113. In the heat insulating member 113, a sponge texture is collapsed as oil penetrated into the sponge texture increases, and, therefore, as shown in FIG. 5, the responsiveness lowers with accumulation of the recording material heating process.

Therefore, similarly as in Embodiment 1, as shown in Table 1, the controller 45 makes the threshold temperature Timage lower when a cumulative amount of the recording material heating process is 80,000 sheets, which is an example of a first cumulative amount, than when the cumulative amount is 2,000 sheets, which is an example of a second cumulative amount smaller than the first cumulative amount

Embodiment 6

In Embodiment 6, in the constitution of the fixing device in Embodiment 5, the above-described control of Embodiment 4 is applied. As shown in FIG. 2, in the case in which the thermistor unit 120 is contacted to the peripheral surface of the fixing roller 121, as shown in FIG. 13, the responsiveness of the thermistor 111 shows a change in some cases, such that the responsiveness is not constant relative to the cumulative sheet number in the heating process.

As shown in FIG. 13, in the thermistor unit 120, the heat-resistant film 112 is gradually abraded with accumulation of sliding with the fixing roller 121, so that the responsiveness of the thermistor 111 becomes high. For this reason, a change speed of the responsiveness of the thermistor 111 with the accumulation of the heating process changes depending on a balance between the heat-resistant property of the heat insulating member 113 and the abrasion of the heat-resistant film 112.

Further, the thermistor unit 120 is contacted to the peripheral surface of the fixing roller 121, so that the responsiveness of the thermistor 111 lowers in some cases due to an unexpected change in state of the peripheral surface of the fixing roller 121. That is, in the case in which a foreign matter, such as paper powder or the toner, is sandwiched and accumulated between the fixing roller 121 and the heat-resistant film 112, the responsiveness of the thermistor 111 lowers. Thus, in the fixing device 40, the responsiveness of the thermistor 111 shows the change in some cases such that the responsiveness is not constant relative to the cumulative sheet number in the heating process.

Therefore, in Embodiment 6, the setting mode is executed during the actuation of the fixing device 40 similarly as in Embodiment 4, so that a proper threshold temperature Timage is determined independently of a current value of the integrated sheet number in the heating process. As a result, even in the case in which the responsiveness of the thermistor 111 shows the change such that the responsiveness is not constant relative to the cumulative amount of the heating process in the fixing device 40, it is possible to set the proper threshold temperature and a proper target temperature.

Other Embodiments

In Embodiment 1, the sheet number counted by the counting portion is not limited to the sheet number of the recording materials P on which the image is formed. The sheet number may also be the cumulative sheet number in the recording material heating process, the output sheet number of images, the number of times of image transfer, a total time when the recording material P is actually heated, and a cumulative value of the time when the fixing belt 101 or the pressing roller 106 rotates. The sheet number of the recording materials P may also be converted into a sheet number in A4-size long edge feeding by being multiplied by a coefficient depending on a length of the recording material P with respect to a feeding direction and may be cumulated. In either case, it goes without saying that the cumulative value of the sheet number of the recording materials P is reset when the thermistor unit 110 is exchanged.

In Embodiment 1, the start of the image forming operation is not limited to the start of the exposure operation. The start of the image forming operation may also be a rotation start of the intermediary transfer belt 31 or the photosensitive drum 11 and a start of feeding of the recording material P to the secondary transfer portion.

In Embodiments 2 and 4, the setting mode of the threshold temperature Timage was executed at the time of temperature rise during the printing. The setting mode of the threshold temperature Timage may also be executed, however, irrespective of the presence or the absence of the print job at the time of first main switch actuation in a day. The setting mode may also be executed in a period from the power-on of the image forming apparatus 1 to a start of the printing operation. The setting mode may also be executed during stand-by of the image forming apparatus 1.

In the setting mode of Embodiment 4, the temperature rise amount in a certain time during certain electrical power supply was measured and the threshold temperature Timage was set on the basis of the temperature rise amount. A time in which the temperature increases from a predetermined temperature to another predetermined temperature, however, in the certain time during the certain electrical power supply is measured and the threshold temperature Timage may also be set on the basis of the measured time.

A parameter for estimating the cumulative amount of the heating process is not limited to the sheet number of the recording materials P passed through the fixing nip N. The parameter may also be a time that is cumulated from the time when the thermistor unit 110 is first used and in which the recording material P passed through the fixing nip N, the number of rotations of the pressing roller 106, and the like.

As described above, the rotatable heating member is not limited to the fixing belt 101, but may also be the fixing roller. A rotatable nip-forming member is not limited to the pressing roller 106, but may also be a pressing belt, a non-rotatable pressing sliding member, a blade, and the like. The heating portion is not limited to the ceramic heater 100, but may also be an induction heat (IH) heating device or a lamp heater. The thermistor unit 110 is replaceable with a temperature detecting portion using a thermocouple, a thermopile, an infrared thermometer, or the like.

A factor of the lowering in responsiveness of the thermistor unit 110 in terms of time is not limited to the lowering in the heat-insulating property of the heat insulating member 113. The heat insulating member 113 is not limited to the heat-resistant film, such as polyimide, which is disposed between the thermistor 111 and the fixing roller, and which slides with the fixing roller 121. The heat insulating member 113 is a pressing member having a spring property for urging the thermistor element against the fixing roller 121 at a predetermined pressure in some cases.

The thermistor unit 110 is not limited to the form in which the thermistor unit is contacted to the surface of the ceramic heater 100 opposite from the fixing belt 101. The thermistor unit is also disposed by being fixed to the ceramic heater 100, or, as shown in FIG. 2, the temperature detection is made by causing a thermistor unit 115 to contact an inner surface of the fixing belt 101.

The thermistor unit 115 slides with an inside surface of the fixing belt 101, and, therefore, there is a possibility that foreign matter, such as the paper powder or the lubricant, is deposited between the thermistor unit 115 and the fixing belt 101 and the responsiveness of the thermistor unit 115 abruptly lowers. For this reason, as in Embodiment 4, it is desirable that the setting mode is executed in a period from the start of the energization to the fixing device 40 until the thermistor detection temperature Theat reaches the threshold temperature Timage and the threshold temperature Timage is set.

INDUSTRIAL APPLICABILITY

According to one aspect, the present invention provides an image forming apparatus capable of suppressing generation of an image defect.

The invention claimed is:

1. An image forming apparatus comprising:

(A) an image forming portion configured to perform an image forming operation to form a toner image on a recording material;

(B) a fixing portion configured to fix the toner image, formed on the recording material by said image forming portion, to the recording material during a fixing process, said fixing portion including:

(a) an endless belt;

(b) a rotatable driving member configured to contact an outer surface of said endless belt to form a nip in cooperation with said endless belt, through which the recording material passes during the fixing process, and configured to rotationally drive said endless belt to feed the recording material through the nip;

(c) a heat generating member provided in contact with an inner surface of said endless belt and configured to generate heat by energization;

(d) a detecting portion including (i) a heat insulating member, and (ii) a detecting element provided on said heat insulating member, said detecting element being configured to detect a temperature of said heat generating member, and to output a detected temperature; and (e) an urging portion configured to urge said detecting portion toward said heat generating member;

(C) a counter configured to count a value corresponding to a cumulative time in which said endless belt is heated, and to output the value; and (D) a controller that receives (a) the detected temperature output by said detecting element, and (b) the value output by said counter, said controller being configured to control a target temperature of the heat generating member and a timing of a start of the image forming operation by said image forming portion based on the detected temperature output by said detecting element and the value output by said counter, wherein, when the value output by said counter corresponds to a first cumulative time, said controller starts the image forming operation at a first timing when the detected temperature output by said detecting element corresponds to a first temperature, and, when the value output by said counter corresponds to a second cumulative time longer than the first cumulative time, said controller starts the image forming operation at a second timing, that is later than the first timing, when the detected temperature output by said detecting element corresponds to a second temperature that is less than the first temperature.

2. The image forming apparatus according to claim 1, wherein said image forming portion includes:

(a) a photosensitive member; and (b) an exposure device capable of executing an exposure operation to form an electrostatic image on said photosensitive member, wherein said image forming portion starts the exposure operation with the start of the image forming operation.

3. An image forming apparatus comprising:

(A) an image forming portion configured to perform an image forming operation to form a toner image on a recording material;

(B) a fixing portion configured to fix the toner image, formed on the recording material by said image forming portion, to the recording material during a fixing process, said fixing portion including:

(a) an endless belt;

(b) a rotatable driving member provided in contact with an outer surface of said endless belt, and configured to form a nip in cooperation with said endless belt, through which the recording material passes during the fixing process, and configured to rotationally drive said endless belt to feed the recording material through the nip;

(c) a heat generating member provided in contact with an inner surface of said endless belt and configured to generate heat by energization;

(d) a detecting portion including (i) a heat insulating member, and (ii) a detecting element provided on said heat insulating member, said detecting element being configured to detect a temperature of said heat generating member, and to output a detected temperature; and (e) an urging portion configured to urge said detecting portion toward said heat generating member;

(C) a counter configured to count a value corresponding to a cumulative number of recording materials subjected to the image forming operation by said image forming portion, and to output the value; and (D) a controller that receives (a) the detected temperature output by said detecting element, and (b) the value output by said counter, said controller being configured to control a target temperature of the heat generating member and a timing of a start of the image forming operation by said image forming portion based on the detected temperature output by said detecting element and the value output by said counter, wherein, when the value output by said counter corresponds to a first cumulative number of recording materials, said controller starts the image forming operation at a first timing when the detected temperature output by said detecting element corresponds to a first temperature, and, when the value output by said counter corresponds to a second cumulative number of recording materials that is greater than the first cumulative number of recording materials, said controller starts the image forming operation at a second timing that is later than the first timing, when the detected temperature output by said detecting element corresponds to a second temperature that is less than the first temperature.

4. The image forming apparatus according to claim 3, wherein said image forming portion includes:

(a) a photosensitive member; and (b) an exposure device capable of executing an exposure operation to form an electrostatic image on said photosensitive member, wherein said image forming portion starts the exposure operation with the start of the image forming operation.

5. An image forming apparatus comprising:

(A) an image forming portion configured to perform an image forming operation to form a toner image on a recording material;

(B) a fixing portion configured to fix the toner image, formed on the recording material by said image forming portion, to the recording material during a fixing process, said fixing portion including:

(a) an endless belt;

(b) a rotatable member provided in contact with an outer surface of said endless belt, and configured to form a heating nip, in cooperation with said endless belt, for heating the toner image, formed on the recording material, to thereby fix the toner image to the recording material;

(c) a heat generating member provided in contact with an inner surface of said endless belt and configured to generate heat by energization;

(d) a detecting portion provided in contact with the inner surface of said endless belt, and including (i) a heat insulating member, and (ii) a detecting element provided on said heat insulating member and configured to detect a temperature of said endless belt and to output a detected temperature; and (e) an urging portion configured to urge said detecting portion toward said heat generating member;

(C) a counter configured to count a value corresponding to a cumulative number of rotations of said rotatable member; and (D) a controller that receives (a) the detected temperature output by said detecting element, and (b) the value output by said counter, said controller being configured to control a target temperature of said heat generating member and a timing of a start of the image forming operation by said image forming portion based on the detected temperature output by said detecting element and the value output by said counter, wherein, when the value output by said counter corresponds to a first cumulative number of rotations, said controller starts the image forming operation at a first timing when the detected temperature output by said detecting element corresponds to a first temperature, and, when the value output by said counter corresponds to a second cumulative number of rotations that is greater than the first cumulative number of rotations, said controller starts the image forming operation at a second timing that is later than the first timing, when the detected temperature output by said detecting element corresponds to a second temperature that is less than the first temperature.

6. The image forming apparatus according to claim 5, wherein said image forming portion includes:

(a) a photosensitive member; and (b) an exposure device capable of executing an exposure operation to form an electrostatic image on said photosensitive member, wherein said image forming portion starts the exposure operation with the start of the image forming operation.

7. An image forming apparatus comprising:

(A) an image forming portion configured to perform an image forming operation to form a toner image on a recording material;

(B) a fixing portion configured to fix the toner image, formed on the recording material by said image forming portion, to the recording material during a fixing process, said fixing portion including:

(a) an endless belt; and (b) a detecting portion provided in contact with an inner surface of said endless belt, and including (i) a heat insulating member, and (ii) a detecting element provided on said heat insulating member and configured to detect a temperature of said endless belt, and to output a detected temperature;

(C) a counter configured to count a value corresponding to a cumulative number of recording materials subjected to the image forming operation by said image forming portion, and to output the value; and (D) a controller that receives (a) the detected temperature output by said detecting element, and (b) the value output by said counter, said controller being configured to control a timing of a start of the image forming operation by said image forming portion depending on the detected temperature output by said detecting element and the value output by said counter, wherein, when the value output by said counter corresponds to a first cumulative number of recording materials, said controller starts the image forming operation at a first timing when the detected temperature output by said detecting element corresponds to a first temperature, and, when the value output by said counter corresponds to a second cumulative number of recording materials that is greater than the first cumulative number of recording materials, said controller starts the image forming operation at a second timing, that is later than the first timing, when the detected temperature output by said detecting element corresponds to a second temperature that is less than the first temperature.

8. The image forming apparatus according to claim 7, wherein said image forming portion includes:

(a) a photosensitive member; and (b) an exposure device capable of executing an exposure operation to form an electrostatic image on said photosensitive member, wherein said image forming portion starts the exposure operation with the start of the image forming operation.

9. The image forming apparatus according to claim 1, wherein said heat insulating member is a foam resin material.

10. The image forming apparatus according to claim 1, wherein a lubricant is applied on the inner surface of said endless belt.

11. The image forming apparatus according to claim 1, wherein, on the basis of the value counted by said counter, said controller determines a temperature at which the image forming operation is started.

12. The image forming apparatus according to claim 3, wherein said heat insulating member is a foam resin material.

13. The image forming apparatus according to claim 3, wherein a lubricant is applied on the inner surface of said endless belt.

14. The image forming apparatus according to claim 3, wherein, on the basis of the number counted by said counter, said controller determines a temperature at which the image forming operation is started.

15. The image forming apparatus according to claim 5, wherein said heat insulating member is a foam resin material.

16. The image forming apparatus according to claim 5, wherein, a lubricant is applied on the inner surface of said endless belt.

17. The image forming apparatus according to claim 5, wherein, on the basis of the value counted by said counter, said controller determines a temperature at which the image forming operation is started.

18. The image forming apparatus according to claim 7, wherein said heat insulating member is a foam resin material.

19. The image forming apparatus according to claim 7, wherein a lubricant is applied on the inner surface of said endless belt.

20. The image forming apparatus according to claim 7, wherein, on the basis of the number counted by said counter, said controller determines a temperature at which the image forming operation is started.

* * * * *